US006103439A

United States Patent [19]

Ogawa et al.

[11] Patent Number: 6,103,439

[45] Date of Patent: Aug. 15, 2000

[54] TONER USED FOR ELECTROPHOTOGRAPHY

[75] Inventors: Satoshi Ogawa, Yamatokoriyama; Hitoshi Nagahama, Uji; Yasuharu Morinishi, Tenri; Tatsuo Imafuku, Nara; Takeaki Ohuchi, Shiki-gun; Toshihisa Ishida, Kashiba; Tadashi Nakamura, Nara, all of Japan

[73] Assignee: Sharp Kabushiki Kaisha, Osaka, Japan

[21] Appl. No.: 09/060,500

[22] Filed: Apr. 15, 1998

[30] Foreign Application Priority Data

Apr. 18, 1997 [JP] Japan ..... 9-102146
Apr. 18, 1997 [JP] Japan ..... 9-102150

[51] Int. Cl.[7] ..... G03G 9/097

[52] U.S. Cl. ..... 430/110; 430/111; 430/137

[58] Field of Search ..... 430/110, 111

[56] References Cited

U.S. PATENT DOCUMENTS 5,424,162 6/1995 Kohri et al. ..... 430/111
5,824,446 10/1998 Nishihara et al. ..... 430/110

FOREIGN PATENT DOCUMENTS 0 827 036 A1 3/1998 European Pat. Off. .
0 872 772 A1 10/1998 European Pat. Off. .
55-156958 12/1980 Japan .
6-222610 8/1994 Japan .
7-152205 6/1995 Japan .
8-12447 2/1996 Japan .
9-34174 2/1997 Japan .
9-73187 3/1997 Japan .

*Primary Examiner*—Roland Martin
*Attorney, Agent, or Firm*—David G. Conlin; Christine C. O'Day

[57] ABSTRACT

In toner 1 containing a binder resin 2, wax particles 3 and a coloring agent, the wax particles 3 are designed so that the ratio of major axis/minor axis is set in the range of 1.4 to 4.0 and so that the major axis L is not more than 6.0 $\mu$m. Moreover, the melt index of the binder resin ranges from 5.0 to 11.0, and the dielectric loss tangent (tan δ) is not more than 5.0. This arrangement prevents the wax particles 3 inside the toner 1 or at the toner 1 surface layer from exposing to or sticking out of the toner 1 surface, thereby making it possible to provide a superior offset-reducing property during the fixing process and electrophotographing toner that can reduce wax contamination on the surface of the toner-bearing body.

7 Claims, 9 Drawing Sheets

TONER USED FOR ELECTROPHOTOGRAPHY

FIELD OF THE INVENTION

The present invention relates to electrophotographing toner that is used in an analog plain-paper copying machine (PPC), a digital plain-paper copying machine, a laser printer, a liguid-crystal shutter printer, an LED (Light-Emitting Diode) printer, etc., so as to develop an electrostatic latent image in the electrophotographic method, the electrostatic printing method and the electrostatic recording method.

BACKGROUND OF THE INVENTION

In general, electrophotographing toner consisting of a binder resin, a coloring agent, a charge-controlling agent, etc. is used in the electrophotographic process. When such electrophotographing toner is manufactured, materials such as a binder resin, a coloring agent, a charge-controlling agent, a mold releasing agent and a lubricant are first mixed in a mixer, and the resulting mixture is melt-kneaded by a two-shaft extrusion-type melt-kneader, and then cooled off so as to preliminarily produce a plate-shaped toner in a solid state. In a conventional process, this toner is further ground into a predetermined particle diameter by a grinding method using a collision plate so as to form electrophotographing toner.

Resins such as polyester resin and styrene-acryl resin are generally used as the binder resin. Nigrosine dye is generally used as the charge-controlling agent. Carbon black, etc. is commonly used as the coloring agent.

In a conventional electrophotographing method using the dry-type developing system, the heat-roll fixing system is generally adopted, in which after an electrostatic latent image has been developed by the toner, it is fixed by being heated and pressed by a heating roller. However, the disadvantage with this method is that some of the toner adheres to the heating roller from the transferring sheet and further contaminates a new transfer sheet that has been transported thereto, resulting in a so-called offset phenomenon.

In order to prevent the offset phenomenon, wax (of the olefin family) is conventionally added to the electrophotographing toner so as to improve its mold-releasing and lubricating properties. Further, wax is often added to the electrophotographing toner for the purpose of easily cleaning the electrophotographing toner from the toner-bearing body.

For example, in order to improve the cleaning performance of the toner, Japanese Laid-Open Patent Publication No. 156958/1980 (Tokukaishou 55-156958) discloses toner to which polyolefin wax having a viscosity within a predetermined range is added.

Moreover, Japanese Examined Patent Publication No. 12447/1996 (Tokukouhei 8-12447) discloses that toner to which polyethylene wax is added has a superior cleaning performance for an organic photoconductor.

However, in the case when polyethylene wax (of the olefin family) is merely added to toner as a mold-releasing agent and a lubricant, the compatibility between the binder resin and the polyethylene wax badly deteriorates, with the result that the polyethylene wax is hardly dispersed into the binder resin, resulting in separated polyethylene wax particles outside the toner particles.

When separated polyethylene wax molecules are produced outside the toner particles, the following problems arise: the charging property of the toner becomes unstable, reducing the image density; the separated polyethylene wax particles badly reduce the fluidity of the toner; and the service life of the toner and the toner-bearing body is shortened due to wax contamination in which the separated polyethylene wax particles contaminate the surfaces of the carrier and the toner-bearing body such as the developing cylinder.

In order to avoid the above-mentioned problems, Japanese Examined Patent Publication No. 12447/1996 (Tokukouhei 8-12447) discloses toner which is made of at least a binder resin and a coloring agent and contains polyethylene wax at a ratio of 0.5 to 10% by weight. In this toner, the number of polyethylene wax particles that have a size of not less than 1 $\mu$m and that are separated outside toner particles is set at not more than 10 per 100 toner particles.

Further, the above-mentioned patent publication also discloses a manufacturing method of toner in which, under a condition that the melt viscosity of the binder resin is not less than 100 Pa·s, the resin, the coloring agent and polyethylene wax are melt-kneaded. When these materials are melt-kneaded under the above-mentioned condition, the binder resin exerts a high viscosity shearing force on the polyethylene wax during the melt-kneading process so that the polyethylene wax is allowed to form fine particles and are dispersed inside the binder resin.

However, the above-mentioned arrangement merely limits the number of polyethylene wax particles that have large diameters and that are separated outside toner particles, and fails to disclose anything about polyethylene wax particles inside the toner particles (including the surface thereof).

If wax particles having large particle diameters exceeding 6 $\mu$m are contained in the toner particles, the wax particles, having large particle diameters existing in the toner particles, tend to expose themselves to the toner surface under high-temperature and high-moisture conditions, causing contamination on the surface of the toner-bearing body in the same manner as separated wax particles having large diameters.

Moreover, if the shape of wax particles is represented by a ratio of major axis/minor axis indicating a shape such as a needle, the wax particles tend to stick out from the toner surface, thereby causing contamination on the surface of the toner-bearing body in the same manner as separated wax particles having large diameters.

Furthermore, in the toner as described in the above-mentioned prior-art publication, when the melt-kneading process is carried out under a condition in which the wax in the olefin family comes to have a viscosity allowing easy dispersion, the coloring agent tends to re-aggregate to form secondary particles, thereby resulting in degradation in the dispersing property of the coloring agent and the subsequent instability or degradation in the charging property. For this reason, in the above-mentioned prior art, the toner, which has a reduced charging property and the subsequent reduced fluidity, is further subjected to reduction in the fluidity due to being left at high temperatures, resulting in high possibilities of toner scattering, fog, etc. during the printing process in a copying machine.

SUMMARY OF THE INVENTION

The objective of the present invention is to provide electrophotographing toner which is superior in reducing offset during the fixing process and makes it possible to suppress wax contamination on the surface of the toner-bearing body.

In order to achieve the above-mentioned objective, the inventors of the present invention have studied vigorously electrophotographing toner and found that the diameter of dispersed wax particles contained in the toner is closely related to wax contamination, especially, on the toner-bearing body (an electrostatic latent-image bearing drum), thereby completing the present invention.

More specifically, in order to achieve the above-mentioned objective, the electrophotographing toner of the present invention contains a binder resin and wax particles dispersed in the binder resin, and the wax particles are set so as to have a major axis/minor axis ratio in the range of 1.0 to 4.0 with the major axis of not more than 6.0 $\mu$m.

The above-mentioned arrangement in which the dispersing state of wax particles is optimized as described above makes it possible not only to provide a superior offset-reducing property in the fixing process, but also to suppress the wax particles inside the toner from being exposed to or sticking out of the toner surface.

Consequently, the service life of the toner-bearing body can be extended by suppressing the wax contamination on the surface of the toner-bearing body.

Further, in the above-mentioned electrophotographing toner, the content of the wax particles is preferably set in the range of 0.5 to 5 parts by weight with respect to 100 parts by weight of the binder resin.

This arrangement makes it possible to maintain at an optimal range the amount of wax particles that are allowed to be exposed to or stick out of the toner surface from the toner surface layer or inside the toner during the fixing process with heat. Thus, it becomes possible to prevent hot-offset during the fixing process while suppressing wax contamination on the surface of the toner-bearing body.

Moreover, the above-mentioned electrophotographing toner is preferably obtained as follows: a kneaded matter, made by kneading the binder resin and the wax particles in a melting state, is rolled to a thickness from 1.2 to 3.0 mm, and then ground after having been cooled off.

With the above-mentioned arrangement, the kneaded matter having been subject to the melt-kneading process is rolled and cooled off to form pellets with a predetermined thickness, and then ground; therefore, it is possible to control the cooling-off speed of the mixture at an optimal range.

Thus, the melted kneaded matter is efficiently cooled off while the wax particles are maintained in a uniformly dispersed state, and is also effectively ground. Therefore, the dispersed state of wax particles as described in claim 1 can be easily realized, wax contamination can be further suppressed, and it becomes possible to prevent faulty grinding during the grinding process.

Further, in the above-mentioned electrophotographing toner, upon kneading the mixture containing the binder resin and melt wax particles, it is preferable to set the setting temperature at the outlet to a temperature that allows the binder resin to have a melt viscosity exceeding 100 Pa·s.

With the above-mentioned arrangement, when the mixture is melt-kneaded at a temperature that allows the binder to have a melt viscosity exceeding 100 Pa·s, a higher shearing force is applied to the wax by the melted binder resin. For this reason, the wax forms fine wax particles, which are desirably dispersed in the binder resin. Consequently, the dispersed state of the wax particles as described claim 1 is readily achieved so that wax contamination can be further suppressed.

Moreover, the above-mentioned electrophotographing toner is preferably designed so that the glass transition temperature of the binder resin is set at not less than 55° C.

With the above-mentioned arrangement, it is possible to prevent the wax particles from being pushed to the toner surface; therefore, wax contamination is further suppressed.

Furthermore, the electrophotographing toner is preferably designed so that the melt index value of the binder resin is in the range of 5.0 to 11.0.

With the above-mentioned arrangement, thermal deformation of the binder resin can be suppressed while the binder resin is maintained to have an appropriate fluidity during the melt-kneading process. Thus, the dispersing property of the toner particles in the binder resin is further improved so that it becomes possible to further suppress wax contamination and also to prevent cold-offset during the fixing process.

In addition, the electrophotographing toner is preferably designed so that a coloring agent is added during the melt-kneading process, and so that the dielectric loss tangent (tan $\delta$) of the binder resin is set to not more than 5.0.

This arrangement makes it possible to control the dispersed state of the coloring agent in the binder resin.

For a fuller understanding of the nature and advantages of the invention, reference should be made to the ensuing detailed description taken in conjunction with the accompanying drawings.

DESCRIPTION OF THE EMBODIMENTS

(EMBODIMENT 1)

The following description will discuss one embodiment of the present example.

Figure 1:
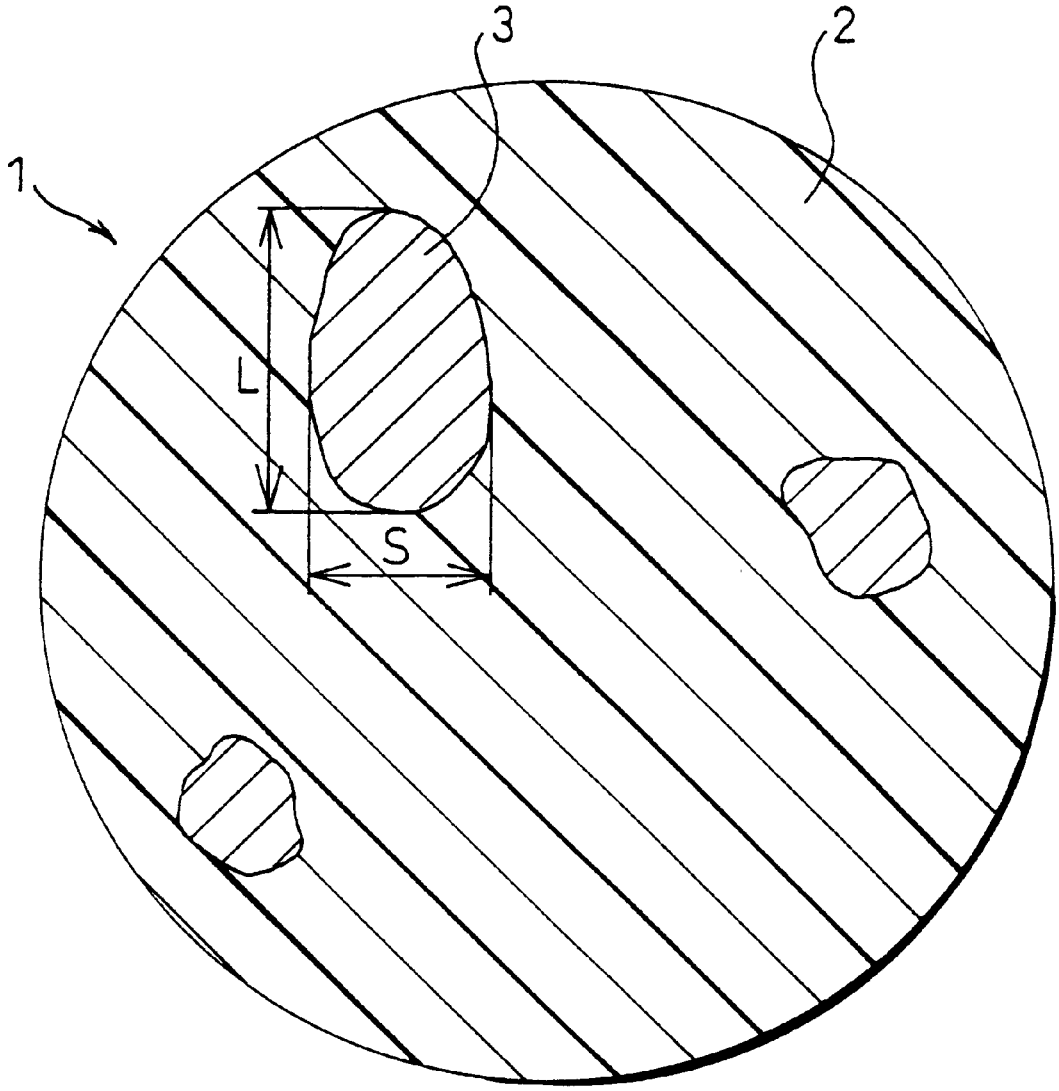
FIG. 1 is a cross-sectional view showing one example of electrophotographing toner in accordance with the present invention.

As illustrated in FIG. 1, toner 1, which serves as electrophotographing toner of the present invention, contains a binder resin 2 and wax particles 3 that are dispersed in the binder resin 2. The wax particles 3 are designed so that the ratio of major axis L/minor axis S is set in the range of 1.0 to 4.0 with the major axis L being set to not more than 6.0 $\mu$m.

The wax particles 3 is more preferably designed so that the ratio of major axis L/minor axis S is set in the range of 1.0 to 3.0 with the major axis L being set in the range of 1.0 to 6.0 μm, and is most preferably designed so that the ratio of major axis L/minor axis S is set in the range of 1.0 to 2.0 with the major axis L being set in the range of 1.0 to 4.0 μm.

By designing the wax particles 3 in the binder resin 2 so as to set the ratio of major axis L/minor axis S in the range of 1.0 to 4.0 with the major axis L being set to not more than 6.0 μm, it becomes possible to suppress the wax particles 3 located in the surface layer of the toner 1 or inside the toner 1 from being exposed to or sticking out of the surface of the toner 1. Thus, wax contamination on the surface of the toner-bearing body can be suppressed.

The ratio of major axis L/minor axis S of the wax particles 3 exceeding 4.0 is not preferable since the wax particles 3 tend to stick out of the toner surface, thereby causing contamination on the surface of the toner-bearing body. Further, the major axis L of the wax particles 3 exceeding 6.0 μm is not preferable since the wax particles 3 in the toner 1 tends to be exposed to the surface of the toner 1, thereby causing contamination on the surface of the toner-bearing body.

Here, in the present specification, the major axis and the minor axis, indicated by L and S in FIG. 1, are defined as the major axis and the short diameter of an orthogonal projection obtained when it is assumed that the orthogonal projection of each of the wax particles 3 has an ellipse shape. Further, the major axis and the minor axis are not given as the average of the major axes and the minor axes of the wax particles 3, but given as the upper limit of the major axes and the minor axes of the wax particles 3. Therefore, for example, the fact that the major axis of the wax particles 3 is not more than 6.0 μm indicates that there are no wax particles 3 having the major axis exceeding 6.0 μm.

The following description will discuss problems caused by the wax particles 3 of the toner 1 contaminating (filming) the surface of the photoconductor drum (the toner-bearing body).

First, an explanation will be given of the principle of electrophotography.

In an electrophotographing process, the surface of a photosensitive layer forming the surface layer of the photoconductive drum is first uniformly charged. In other words, for example, by applying a high voltage to a corona wire, ionized air is shifted to the surface of the photosensitive layer so that an electric field is formed.

Next, the surface of the photosensitive layer thus charged is subject to exposure so as to form an electrostatic latent image thereon. In other words, a uniform electric field, formed by ions adhering to the surface of the photosensitive layer, is formed into an electrostatic latent image by irradiating it with light.

In this case, when a positive latent image is formed, the light irradiation excites electrons or positive holes from inside the photosensitive layer with respect to the photosensitive layer corresponding to the background of an image, thereby neutralizing the ions on the surface of the photosensitive layer by the electrons or the positive holes. In other words, in the case of the photosensitive layer negatively charged, holes inside the photosensitive layer are excited by the light irradiation so that the negative ions on the surface of the photosensitive layer are brought into the excited holes, with the result that the negative charge is eliminated.

In the electrophotographing process, the electrostatic latent image (the image region) on the surface of the photoconductive drum is further visualized by the toner 1 that has been friction-charged so that a toner image is obtained. Thereafter, the toner image is transferred onto a recording medium such as paper, and an image is formed on the recording medium by fixing the transferred toner image. Simultaneously, a cleaning operation is carried out.

Once wax particles 3 of the toner 1 contaminate the surface of the photoconductive drum, a wax layer (a filming layer) is partially formed on the surface of the photoconductive drum (the toner-bearing body) due to the wax particles 3. This wax layer, which has an insulating property, electrically interferes with neutralization of ions on the surface of the photosensitive layer during the exposure, making it impossible to erase charges of negative ions. Therefore, fog and black stripes appear on an image formed on the recording medium.

As described above, fog and black stripes occur in proportion to the degree of wax contamination on the surface of the photoconductor drum (the toner-bearing body).

The following materials are adopted as the binder resin 2: homopolymers of styrene or its substitution products, such as polystyrene, poly-p-chlorostyrene and polyvinyltoluene; styrene copolymers, such as styrene-p-chlorostyrene copolymer, styrene-propylene copolymer, styrene-vinyltoluene copolymer, styrene-vinylnaphthalene copolymer, styrene-methylacrylate copolymer, styrene-ethylacrylate copolymer, styrene-acrylate n-butyl copolymer, styrene-acrylate-2-ethylhexyl copolymer, styrene-methylmethacrylate copolymer, styrene-ethylmethacrylate copolymer, styrene-methacrylate n-butyl copolymer, styrene-α-chloromethylmethacrylate copolymer, styrene-acrylonitrile copolymer, styrene-vinylmethylether copolymer, styrene-vinylmethylketone copolymer, styrene-butadiene copolymer, styrene-isoprene copolymer, styrene-acrylonitrile-indene copolymer, styrene-maleic acid copolymer, styrene-maleate copolymer; polymethylmethacrylate, polybutylmethacrylate, polyvinylchloride, polyvinylacetate, saturated polyester, polyurethane, polyamide, epoxy resins, polyvinylbutylal, polyacrylate resin, rosin, modified rosin, terpene resin, phenol resin, aromatic petroleum resins, chlorinated paraffin, etc. One kind of these resins as exemplified may be used, or two kinds or more of them may be used in a properly mixed manner.

Among the materials as listed above, styrene copolymers and saturated polyester are preferably adopted as the binder resin 2. Further, among styrene copolymers, styrene-methylmethacrylate copolymer and styrene-methacrylate n-butyl copolymer are more preferably adopted.

The melt viscosity of the binder resin 2 is preferably set at not less than 100 Pa·s at 160° C., and is more preferably set in the range of 110 to 200 Pa·s.

Here, the melt viscosity of the present invention is a value calculated from flow values that were measured by the flow-test method (reference test) stipulated in JIS K 7210.

The glass transition temperature (Tg) of the binder resin 2 is preferably set at not less than 55° C., and is more preferably set in the range of 58 to 63° C. By limiting the glass transition temperature of the binder resin 2 to not less than 55° C., it becomes possible to suppress the wax particles 3 from being pushed up to the surface of the toner 1. As a result, wax contamination on the toner-bearing body can be further reduced. Moreover, it becomes possible to shorten the length of time required for the melt-kneaded matter to be cooled off to the glass transition temperature of the binder resin 2, and consequently to further improve the dispersing property of the wax particles 3.

When the glass transition temperature of the binder resin 2 is less than 55° C., wax contamination on the toner-bearing body tends to occur more easily. Supposedly, this is because the binder resin 2 is more easily subjected to thermal deformation, with the result that the wax particles 3 are pushed up to the surface of the toner 1.

The melt index (MI) value of the binder resin 2 is preferably set in the range of 5.0 to 11.0 prior to the melt-kneading process, and is more preferably set in the range of 6.0 to 8.0.

By setting the melt index value of the binder resin 2 in the range of 5.0 to 11.0, the thermal deformation to the binder resin can be suppressed while the binder resin 2 is maintained to have a proper fluidity during the melt-kneading process. Thus, it becomes possible to further reduce the wax contamination by improving the dispersing property of the toner particles 3 in the binder resin 2, and also to prevent cold-offset during the fixing process.

Moreover, when the melt index value of the binder resin 2 is set to not more than 11.0, the melted binder resin 2 having a low fluidity exerts a greater shearing force on wax inside the binder resin 2 during the melt-kneading process; thus, the wax can be dispersed inside the binder resin 2 as finer wax particles 3.

In the case of the melt index value of the binder resin 2 of less than 5.0, since the fluidity of the binder resin 2 during the melt-kneading process becomes too high, cold-offset tends to occur more easily during the fixing process On the other hand, in the case of the melt index value of the binder resin 2 exceeding 11.0, the wax contamination tends to occur more easily. Supposedly, this is because the binder resin 2 is more easily subject to thermal deformation, with the result that the wax particles 3 are pushed up to the surface of the toner 1.

Here, the melt index values of the present invention are defined as melt index values (melt flow rate) that are measured by using the B method stipulated in JIS K 7210.

The weight-average molecular weight of the binder resin 2 is preferably set in the range of 3,000 to 200,000. Further, the number-average molecular weight of the binder resin 2 is preferably set in the range of 1,000 to 150,000.

Any wax is used for forming the wax particles 3 as long as it has a higher mold-releasing property (sliding property) as compared with the binder resin 2; however, it is preferable for the wax to have a lower melt viscosity at 160° C. as compared with the binder resin 2. The melt viscosity at 160° C. is preferably set in the range of 20 to 400 Pa·s, more preferably set in the range of 20 to 80 Pa·s, and most preferably set in the range of 20 to 40 Pa·s.

More specifically, with respect to the wax, natural wax such as carnauba wax and artificial waxes, such as polyethylene wax, polypropylene wax, polyvinylidene fluoride and polytetrafluoroethylene, are listed. Among these waxes, polyethylene and polypropylene are most preferably adopted.

The content of the wax particles 3 is preferably set in the range of 0.5 to 5 parts by weight with respect to 100 parts by weight of the binder resin 2, and is more preferably set in the range of 1.0 to 2.0 parts by weight with respect to 100 parts by weight of the binder resin 2.

In the case of the content of the wax particles 3 of less than 0.5 parts by weight with respect to 100 parts by weight of the binder resin 2, the mold-releasing property of the wax particles 3 is reduced, thereby causing offset in the fixing process. On the other hand, in the case of the content of the wax particles 3 exceeding 5 parts by weight with respect to 100 parts by weight of the binder resin 2, wax contamination tends to occur on the surface of the toner-bearing body.

In addition to the binder resin 2 and the wax particles 3, the toner 1 contains a coloring agent. With respect to the coloring agent, for example, the following materials are listed: inorganic pigments, such as carbon black, iron black, iron blue, chrome yellow, titanium oxide, zinc white, alumina white and calcium carbonate; organic pigments, such as copper phthalocyanine blue, victoria blue, copper phthalocyanine green, malachite green, Hansa yellow G, benzidine yellow, lake red C and quinacridon magenta; and organic dyes such as rhodamine dies, triallylmethane dyes, anthraquinone dyes, monoazo dyes and diazo dyes. Among these materials, conductive materials are more preferably used, and among conductive materials, carbon black is most preferably used. Only one kind of these materials may be used, or some of them may be used in a combined manner so as to fit the color of the toner 1. The amount of use of the coloring agent is not particularly limited, but is preferably set in the range of 1 part by weight to 25 parts by weight with respect to 100 parts by weight of the binder resin 2, and is most preferably set in the range of 3 parts to 20 parts by weight.

Here, in the same manner as the wax particles 3, the coloring agent differs greatly in its dispersed state inside the binder resin 2 depending on melt-kneading conditions or rolling and cooling conditions. In the case when the coloring agent is not dispersed preferably inside the binder resin 2, it easily re-aggregates to form secondary particles; this causes instability in the charging property such as reduction in the charging property when the coloring agent is a conductive material. In other words, the coloring agent of a conductive material has a reduced value of resistance in the resulting toner 1 when its dispersing property inside the binder resin 2 deteriorates, thereby raising problems such as toner scattering and fog due to the reduction in the charging quantity of toner 1.

In the toner 1 of the present invention, since the melt index value of the binder resin 2 is set in the above-mentioned range, the dispersing property of the coloring agent inside the binder resin 2 is improved so that fog in the transferring process is suppressed even under high-temperature conditions (for example, for two days at a temperature of 50°), thereby making it possible to obtain good picture quality.

Further, the toner 1 may be provided as a magnetic toner containing magnetic materials such as iron, cobalt, nickel, magnetite, hematite and ferrite. Moreover, the toner 1 may also contain a charging-control agent, etc. such as nigrosine and quaternary ammonium salt as an inner additive agent, if necessary. In addition, the toner 1 may contain an externally additive agent such as colloidal silica, powdered fluororesin and a metallic salt of higher fatty acid, if necessary.

The following description will discuss a manufacturing process of the toner 1.

The toner 1 of the present invention is manufactured as follows: After a mixture of materials containing binder resin 2, wax and a coloring agent has been melt-kneaded by a kneader, the resulting kneaded matter is rolled into pellets and cooled off, and the kneaded matter in pellets, which has been cooled off, are ground and classified into a predetermined particle diameter.

The above-mentioned mixture of materials is readily prepared by loading the binder resin 2, the wax, the coloring agent, etc., into a mixer and mixing the materials uniformly.

The kneader, used for the melt-kneading process of the mixture of materials, is preferably adjusted so that the temperature at the outlet (the outlet temperature) allows the binder resin 2 to have a melt viscosity of not less than 100 Pa·s, and more preferably adjusted so that it allows the binder resin 2 to have a melt viscosity in the range of 110 to 200 Pa·s.

By setting the temperature of the outlet of the kneader at a temperature that allows the binder resin 2 to have a melt viscosity of not less than 100 Pa·s, the melted binder resin 2 applies a higher shearing force to the wax. Thus, the wax is desirably dispersed into the binder resin 2 as fine wax particles 3. Therefore, the above-mentioned arrangement makes it possible to easily achieve a preferably dispersed state of the wax particles 3, and consequently to further suppress wax contamination occurring on the surface of the toner-bearing surface.

In the case when the outlet temperature of the kneader is set at a temperature that allows the binder resin 2 to have a melt viscosity of less than 100 Pa·s, the dispersing property of the wax particles 3 is insufficient, with the result that separation between the binder resin 2 and the wax particles 3 tends to occur. Consequently, wax contamination tends to occur on the surface of the toner-bearing surface more easily.

The melt-kneaded matter is preferably rolled into a thickness in the range of 1.2 mm to 3.0 mm, and is more preferably rolled into a thickness in the range of 1.7 to 2.5 mm.

With this arrangement, the melt-kneaded matter is efficiently cooled off while the wax particles 3 are maintained in a uniformly dispersed state, and is also ground more preferably. Therefore, it becomes possible to easily achieve a superior dispersed state of the wax particles 3, and also to further suppress wax contamination, as well as preventing faulty grounding operation.

In the case when the melt-kneaded matter is rolled into a thickness of less than 1.2 mm, the melt-kneaded matter is rolled too much to cause a number of wax particles 3 that have been extended to have a needle-like shape. Consequently, wax contamination tends to occur on the toner-bearing surface more easily.

Moreover, in the case when the melt-kneaded matter is rolled into a thickness exceeding 3.0 mm, the cooling effect resulted from the rolling process that improves the cooling rate of the melt-kneaded matter is reduced, with the result that the cooling rate of the melt-kneaded matter is slowed down; therefore, in the next process, pellets in a semi-melting state sometimes have to be ground. For this reason, a faulty grinding process in which ground objects adhere to each other to form lumps tends to occur, failing to provide a desirable distribution in the toner particle size.

After the melt-kneaded matter has been rolled, the cooling process is preferably carried out at a temperature of less than 15° C. in order to increase the cooling rate. Moreover, the cooling rate after the rolling process of the melt-kneaded matter is preferably set at not less than 10° C./sec.

Additionally, the aforementioned inner additive agent, contained in the toner 1 on demand, can be added to the mixture of materials. Moreover, the aforementioned externally additive agent can be mixed with the powdered matter obtained through the grinding and classifying processes.

The toner 1 as it is may be used as a single-compound developer, or may be mixed with carrier and used as two-ingredients developer. In particular, the toner 1 is suitable for use in a binary-compound developer.

With respect to the above-mentioned carrier, the material is not particularly limited, and carriers, such as iron powder, ferrites (crystals between iron and manganese, copper, zinc, magnesium, etc.), and magnetite, or binder-type carries in which a magnetic material is dispersed into a resin, may be adopted.

The following description will discuss the present invention in detail by means of examples and comparative examples; however, the present invention is not intended to be limited by these. Here, each of the tests in the examples and comparative examples is carried out as described below:

1. Wax Contamination

Binary-compound developer, obtained by mixing toner with a predetermined amount of binary-compound developing ferrite carrier (having the average particle diameter of 100 $\mu$m and an insulation resistance of $10^9$ to $10^{12}$ Ω·cm), was subjected to actual copying tests under a high-temperature and high-moisture condition by using a copying machine on the market (Brand name "SD-2060" made by Sharp Corporation) More specifically, a predetermined original was copied onto sheets of A-4 paper repeatedly by the above-mentioned copying machine under a condition with a temperature of 35° C. and a moisture of 85%, and the resulting copied images on the sheets were visually observed; thus, evaluation was carried out by counting the number of the sheets of paper that had been outputted until fog or black stripes first appeared on the copied image.

2. Cold-Offset During the Fixing Process

Actual copying tests were carried out on the binary-compound developer made of the toner by using the above-mentioned copying machine at room temperature under normal moisture. More specifically, under a condition in which temperature was 20° C., moisture was 65% and the fixing temperature was 150° C., a predetermined original was copied onto sheets of paper by the copying machine, and when offset was seen on a copied image on the paper, this was estimated as "bad (x)" and when offset was not seen on the copied image, this was estimated as "good (○)".

3. Hot-Offset During the Fixing Process

Actual copying tests were carried out on the binary-compound developer made of the toner by using the above-mentioned copying machine at room temperature under normal moisture. More specifically, under a condition in which temperature was 20° C., moisture was 65% and the fixing temperature was 220° C., a predetermined original was copied onto sheets of paper by the copying machine, and when offset was seen on a copied image on the paper, this was estimated as "bad (x)" and when offset was not seen on the copied image, this was estimated as "good (○)".

4. Grinding Property

The toner was visually estimated under a condition in which temperature was 20° C. and moisture was 65%, and when there were toner particles forming lumps of not less than 3 mm in diameter, this was estimated as "bad (x)" and when there were no toner particles forming lumps of not less than 3 mm in diameter, this was estimated as "good (○)".

EXAMPLE 1

In the present example, styrene-n-butylmethacrylate copolymer was used as the binder resin 2. The melt viscosity at 160° C. of styrene-n-butylmethacrylate was measured by using a flow tester of the depressing system (Brand Name: "CFT 500", made by Shimadzu Seisakusho Ltd", and the resulting value 130 Pa·s was obtained.

The melt viscosity of the binder resin 2 was calculated from flow values that had been measured by the flow-test method (reference test) stipulated in JIS K 7210. More specifically, a sample of the binder resin 2 was ground by a mixer mill, this was filtered through the 100 mesh, thereby obtaining binder resin 2 in powder, and 1 gram of this was precisely weighed. Next, the binder resin 2 in powder was loaded into a cylinder which had been heated to 80° C., and was preheated for 300 seconds. Here, during the preheating process, the binder resin 2 was subjected to a degassing process. Then, after the preheating process, the binder resin 2 was extruded through a die by a piston (a plunger) at a predetermined pressure (5 kgf/cm$^2$) with the cylinder being heated with a temperature increase of 6° C./min.

Then, measurements were started from the time when the descending speed of the piston exceeded a predetermined value, and the amount of outflow of the binder resin 2 that had passed through the die, that is, the distance of descent (the stroke) of the piston per constant cross-sectional area (1.0 cm$^2$), was recorded on a graph as a function with time. Here, the measurements were completed when the extruding process of the binder resin 2 stopped. Then, the distance of descent (cm/s) of the piston per one second at the time when the cylinder reached the predetermined temperature (160° C.) was found from the above-mentioned graph, and this value was defined as the flow value Q (cm$^3$/s) of the binder resin 2 at the predetermined temperature (160° C.).

Further, the melt viscosity η (Pa·s) of the binder resin 2 at the predetermined temperature (160° C.) was found by the following equation:

$$\eta = p \times \pi \times r^4/(8 \times 1 \times Q),$$

where the flow value of the binder resin 2 at the predetermined temperature (160° C.) is Q (cm$^3$/s), the extruding pressure by the piston p (Pa)=5×9.80665×10$^4$, the radial of the die (the capillary) r (m)=5.0×10$^{-4}$ and the length of the die 1 (m)=1.0×10$^{-3}$.

Moreover, the glass transition temperature of the styrene-n-butylmethacrylate copolymer was measured by a differential scanning thermal analyzer (Brand name: "Tg-DTA-TYPE 200" made by Seiko Electronic Industry Co., Ltd.), and the resulting value 62° C. was obtained.

Furthermore, the melt-index value of the styrene-n-butylmethacrylate copolymer was measured by a melt indexer (Brand name: "P-Type 001" made by Toyo Seiki Co., Ltd.) conforming to JIS K 7210 (ASTM D-1238-57T), and the resulting value 6.0 was obtained. The above-mentioned melt indexer has 9.5 mm in the inner diameter of the cylinder, 9.48 mm in the outer diameter of the piston, 175 mm in the length of the piston, 8 mm in the length of the die (orifice) and 2.095 mm in the inner diameter of the die.

Under a condition in which the amount of charge of the powdered binder resin 2 was 8.0 g, the test temperature was 150° C. and the test load was 2160 gf, the average value t (sec.) of the time required for the piston to move 2.50 cm was measured, and supposing that the density of the binder 2 at the test temperature (150° C.) ρ(g/cm$^3$)=0.980, the melt index value of the binder resin 2 was found by using B method (automatic time-measuring method) stipulated in JIS K 7210 in accordance the following equation:

$$\text{melt index value}(g/10\ \text{min.}) = 427 \times 2.50 \times \rho/t.$$

Here, the value 427 in the above equation was found from [the average value of the areas (cm$^2$) of the piston and the cylinder] ×600.

Then, 100 parts by weight of the styrene-n-butylmethacrylate copolymer, 7 parts by weight of carbon black (Brand name: "MA-100S" made by Mitsubishi Chemical Industries Ltd.) serving as a coloring agent, 2 parts by weight of quaternary ammonium salt (Brand name: "Bontron P-51" made by Orient Chemical Industries, Ltd.) serving as a charge-controlling agent and 2 parts by weight of polyethylene wax (Brand name: "PE-130" made by Hoechst AG, having a melt viscosity of 27 Pa·s at 160° C.) serving as wax were mixed and stirred by a dry mixer (a Henschel mixer) at 400 rpm, and a mixture of the materials was obtained.

Next, after the mixture of the materials had been melt-kneaded at 150 rpm by using a two-shaft kneader which was set at 180° C. at the outlet temperature, the resulting melt-kneaded matter was rolled and cooled off to 12° C. so that toner pellets (kneaded matter in pellets) were obtained. The thickness of the toner pellets was measured by commercial vernier calipers, and the resulting value 1.7 mm was obtained.

Thereafter, the toner pellets were ground by an air-jet mill (a grinding machine), and classified so that powder having the diameter ranging from 5 to 15 μm was obtained. To this powder was added 0.3 parts by weight of colloidal silica (Brand name: "R972" made by Nippon Aerosil Co., Ltd.) as an externally additive agent and mixed in the dry kneader. The above-mentioned ferrite carrier for use in a two-compound developer was a crystal constituted by iron oxide that is a main ingredient, copper oxide, zinc oxide and magnesium oxide.

Thus, toner 1 having the average particle diameter of 10 μm, in which wax particles 3 made of polyethylene wax were dispersed in the binder resin 2 made of styrene-n-butylmethacrylate copolymer, was obtained.

Next, the ratio of major axis/minor axis and the major axis of the wax particles 3 being dispersed in the toner 1 were measured.

In other words, tetrahydrofuran (THF) was added to 3 mg of the toner 1 thus obtained, and dissolved, resulting in a mixed solution of 30 ml. In this case, in the mixed solution, the binder resin 2 in the toner 1 was all dissolved; however, the wax particles 3 in the toner 1 were suspended in the mixed solution without being dissolved. Further, insoluble matters other than the wax particles 3 (such as carbon black and colloidal silica) were deposited.

Next, the mixed solution was separated by a commercial centrifugal separator into a supernatant liquid containing the wax particles 3 and a deposition. 0.5 ml of the supernatant liquid containing the wax particles 3 was taken and filtered by using a commercial membrane filter with 0.1 μm meshes, with the result that some wax particles 3 were obtained as residues on the membrane filter. Here, carbon black and colloidal silica are allowed to pass through the membrane filter with 0.1 μm meshes, and do not remain.

The wax particles 3 on the membrane filter were vacuum-dried and a metallic film was vapor-deposited thereon by sputtering, and then the membrane filter was photographed through a commercial scanning-type electronic microscope. The major axis and minor axis of the wax particles 3 were actually measured on the photograph obtained through the electronic microscope, and the actual major axis and minor axis of the wax particles 3 were found from the actual measurements and the magnification of the electronic microscope; thus, the ratio of major axis/minor axis ranging from 1.0 to 2.0 and the diameter ranging from 1.0 to 4.0 μm were obtained. The results are shown in Table 1 together with the main manufacturing conditions.

The toner 1 thus obtained was subjected to the respective tests using the above-mentioned methods, with the result that no contamination due to the toner 1 was observed up to completion of 130,000 sheets. Further, good results were obtained with respect to cold-offset during the fixing process, hot-offset during the fixing process and the grinding property. The results of the tests are shown in Table 1.

Moreover, in the actual copying tests on wax contamination, the image density and fog density of copied images on sheets of paper derived from the original image were measured by using a reflection densitometer made by Macbeth Co., Ltd. (Apparatus name "PROCESS MEA- SUREMENTS RD 914 TYPE"), with the result that the image density was maintained between 1.35 to 1.40 from the beginning to completion of 100,000 sheets with the fog density ranging from 0.4 to 0.6, showing good performance.

EXAMPLE 2

In the present example, styrene-n-butylmethacrylate copolymer was used, in which respective property values of the melt viscosity, the glass transition temperature and the melt index value were 200 Pa·s, 63° C. and 5.0 at 160° C., which were measured in the same manner as Example 1.

Then, 100 parts by weight of the styrene-n-butylmethacrylate copolymer was used as the binder resin 2, and mixing and stirring processes and a melt-kneading process were carried out in the same manner as Example 1 except that the amount of use of polyethylene wax was changed from 2 parts by weight to 5 parts by weight, resulting in a melt kneaded matter.

Next, the melt-kneaded matter was rolled under a predetermined condition and cooled off to 12° C. so that toner pellets were obtained. The thickness of the toner pellets was measured by commercial vernier calipers, and the resulting value 2.5 mm was obtained. Thereafter, grinding and classifying processes were carried out in the same manner as Example 1, and colloidal silica was added and mixed with the resulting powder in the same manner as Example 1. Thus, toner 1 having the average particle diameter of 10 $\mu$m, in which wax particles 3 made of polyethylene wax were dispersed in the binder resin 2 made of styrene-n-butylmethacrylate copolymer, was obtained.

Figure 2:
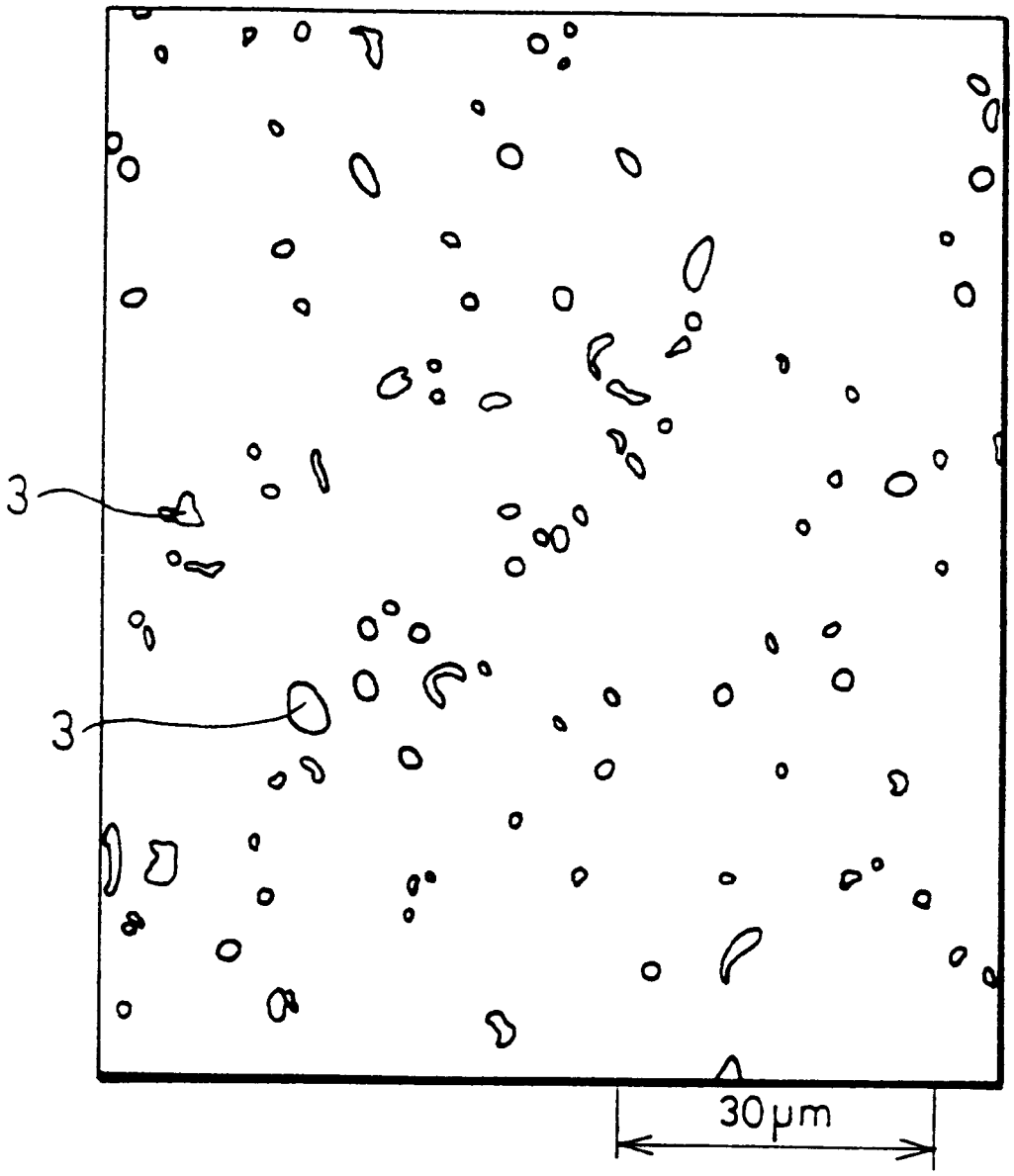
FIG. 2 is a projected plan showing one example of wax particles contained in the toner of the present invention.

Next, the ratio of major axis/minor axis and the major axis of the wax particles 3 being dispersed in the toner 1 were measured by using electronic-microscopic photographs in the same manner as Example 1. FIG. 2 shows the wax particles 3 shining white on the photograph. Further, the respective tests were carried out on the toner 1 by using the above-mentioned methods. The results of these measurements and tests are shown in Table 1 together with the main manufacturing conditions of the toner 1.

EXAMPLE 3

In the present example, styrene-n-butylmethacrylate copolymer was used, in which respective property values of the melt viscosity, the glass transition temperature and the melt index value were 110 Pa·s, 58° C. and 8.0 at 160° C., which were measured in the same manner as Example 1.

Then, 100 parts by weight of the styrene-n-butylmethacrylate copolymer was used as the binder resin 2, and mixing and stirring processes and a melt-kneading process were carried out in the same manner as Example 1 except that the amount of use of polyethylene wax was changed from 2 parts by weight to 1 part by weight, resulting in a melt kneaded matter.

Next, the melt-kneaded matter was rolled under a predetermined condition and cooled off to 12° C. so that toner pellets were obtained. The thickness of the toner pellets was measured by commercial vernier calipers, and the resulting value 1.2 mm was obtained. Thereafter, grinding and classifying processes were carried out in the same manner as Example 1, and colloidal silica was added and mixed with the resulting powder in the same manner as Example 1. Thus, toner 1 having the average particle diameter of 10 $\mu$m, in which wax particles 3 made of polyethylene wax were dispersed in the binder resin 2 made of styrene-n-butylmethacrylate copolymer, was obtained.

Figure 3:
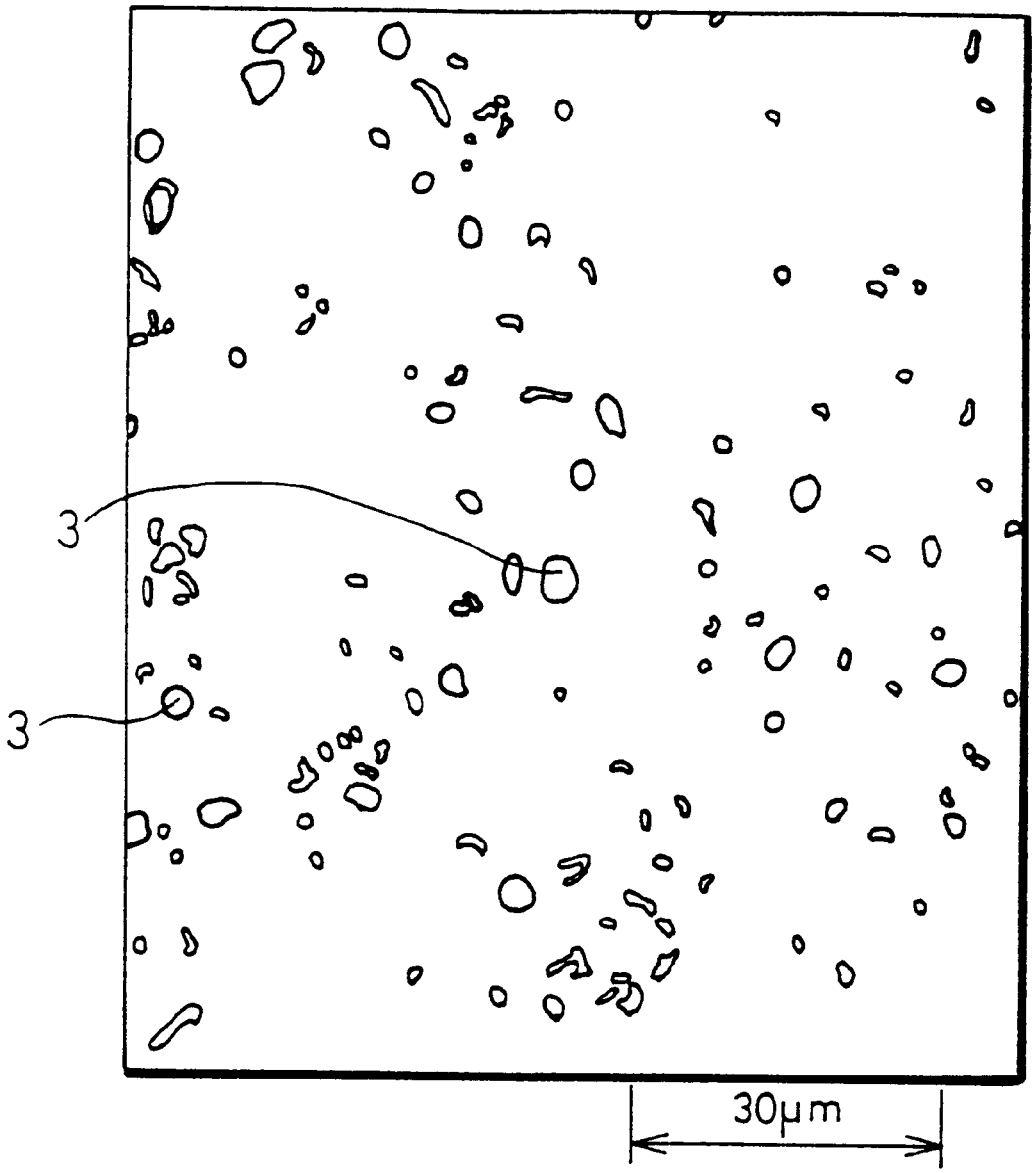
FIG. 3 is a projected plan showing another example of wax particles contained in the toner of the present invention.

Next, the ratio of major axis/minor axis and the major axis of the wax particles 3 being dispersed in the toner 1 were measured by using electronic-microscopic photographs in the same manner as Example 1. FIG. 3 shows the wax particles 3 shining white on the photograph. Further, the respective tests were carried out on the toner 1 by using the above-mentioned methods. The results of these measurements and tests are shown in Table 1 together with the main manufacturing conditions of the toner 1.

EXAMPLE 4

In the present example, styrene-n-butylmethacrylate copolymer was used, in which respective property values of the melt viscosity, the glass transition temperature and the melt index value were 100 Pa·s, 56° C. and 10.5 at 160° C., which were measured in the same manner as Example 1. Then, 100 parts by weight of the styrene-n-butylmethacrylate copolymer was used as the binder resin 2, and mixing and stirring processes and a melt-kneading process were carried out in the same manner as Example 1 except that the amount of use of polyethylene wax was changed from 2 parts by weight to 0.5 parts by weight, resulting in a melt kneaded matter.

Next, the melt-kneaded matter was rolled under a predetermined condition and cooled off to 12° C. so that toner pellets were obtained. The thickness of the toner pellets was measured by commercial vernier calipers, and the resulting value 3.0 mm was obtained. Thereafter, grinding and classifying processes were carried out in the same manner as Example 1, and colloidal silica was added and mixed with the resulting powder in the same manner as Example 1. Thus, toner 1 having the average particle diameter of 10 $\mu$m, in which wax particles 3 made of polyethylene wax were dispersed in the binder resin 2 made of styrene-n-butylmethacrylate copolymer, was obtained.

Figure 4:
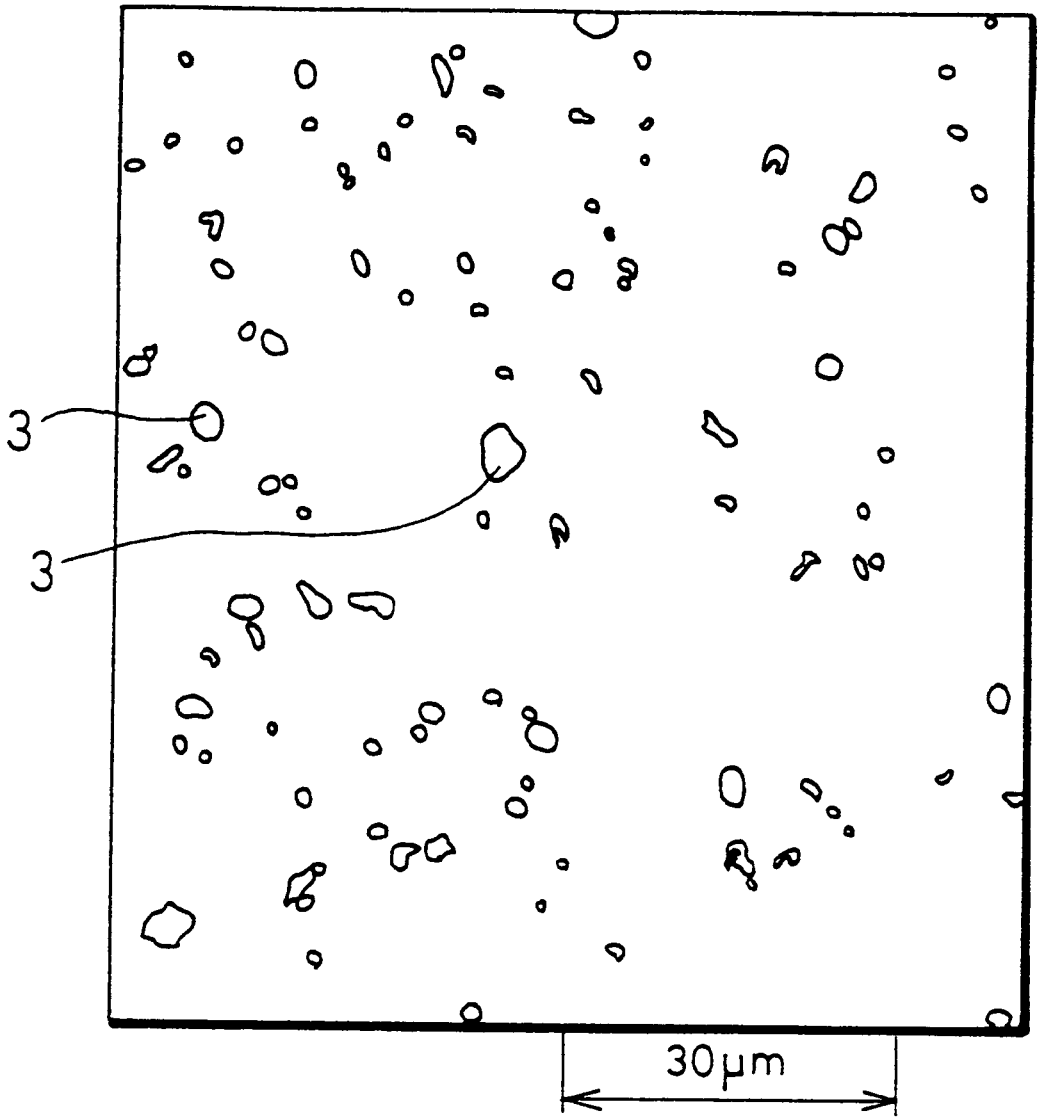
FIG. 4 is a projected plan showing still another example of wax particles contained in the toner of the present invention.

Next, the ratio of major axis/minor axis and the major axis of the wax particles 3 being dispersed in the toner 1 were measured by using electronic-microscopic photographs in the same manner as Example 1. FIG. 4 shows the wax particles 3 shining white on the photograph. Further, the respective tests were carried out on the toner 1 by using the above-mentioned methods. The results of these measurements and tests are shown in Table 1 together with the main manufacturing conditions of the toner 1.

COMPARATIVE EXAMPLE 1

In the present comparative example, styrene-n-butylmethacrylate copolymer was used, in which respective property values of the melt viscosity, the glass transition temperature and the melt index value were 80 Pa·s, 60° C. and 7.4 at 160° C., which were measured in the same manner as Example 1.

Then, mixing and stirring processes and a melt-kneading process were carried out in the same manner as Example 1 except that 100 parts by weight of the styrene-n-butylmethacrylate copolymer was used as the binder resin, thereby resulting in a melt kneaded matter.

Next, the melt-kneaded matter was rolled under a predetermined condition and cooled off to 12° C. so that toner pellets were obtained. The thickness of the toner pellets was measured by commercial vernier calipers, and the resulting value 0.9 mm was obtained. Thereafter, grinding and classifying processes were carried out in the same manner as Example 1, and colloidal silica was added and mixed with the resulting powder in the same manner as Example 1. Thus, toner 1 having the average particle diameter of 10 $\mu$m was obtained.

Figure 5:
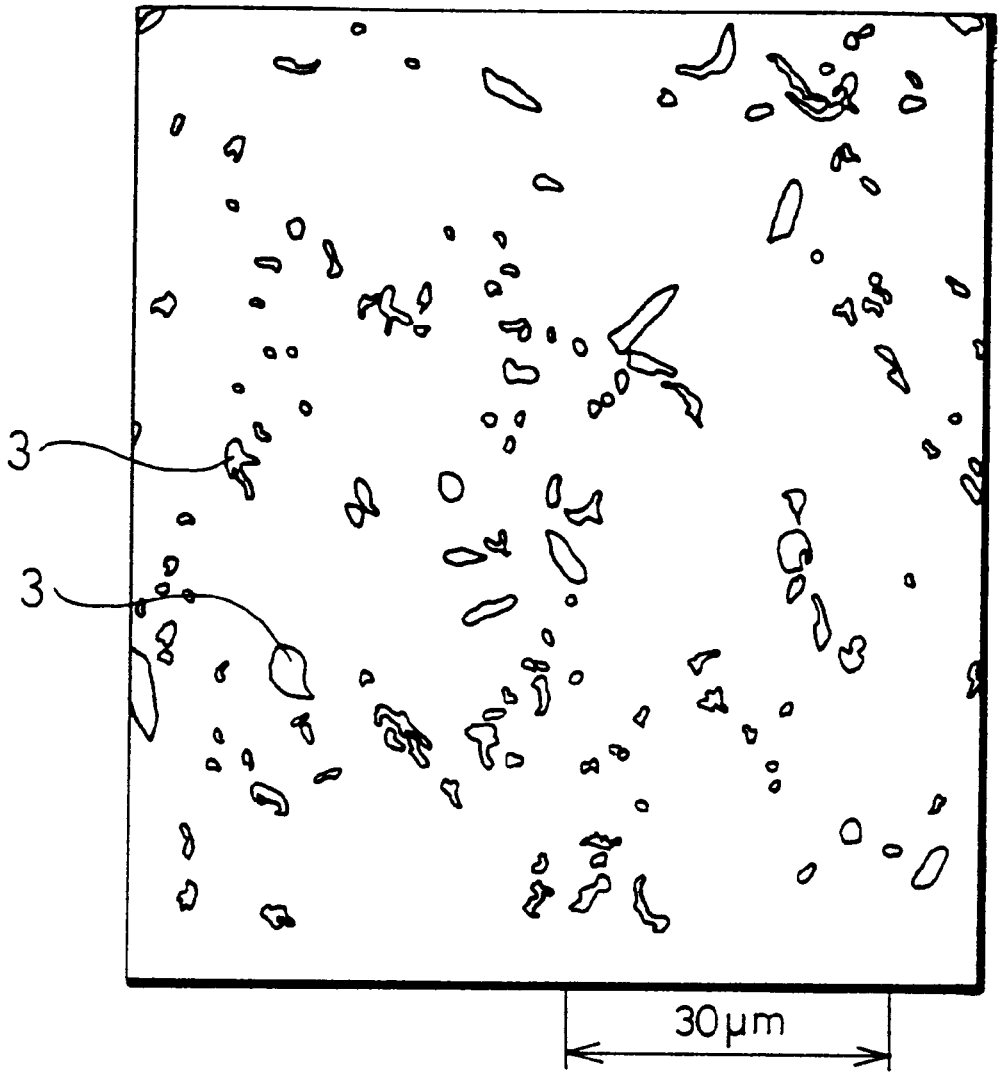
FIG. 5 is a projected plan showing still another example of wax particles contained in the toner of the present invention.

Next, the ratio of major axis/minor axis and the major axis of the wax particles 3 being dispersed in the toner 1 were measured by using electronic-microscopic photographs in the same manner as Example 1. FIG. 5 shows the wax particles 3 shining white on the photograph. Further, the respective tests were carried out on the toner by using the above-mentioned methods. The results of these measurements and tests are shown in Table 1 together with the main manufacturing conditions of the toner.

COMPARATIVE EXAMPLE 2

In the present comparative example, styrene-n-butylmethacrylate copolymer was used, in which respective property values of the melt viscosity, the glass transition temperature and the melt index value were 90 Pa·s, 60° C. and 7.4 at 160° C., which were measured in the same manner as Example 1.

Then, mixing and stirring processes and a melt-kneading process were carried out in the same manner as Example 1 except that 100 parts by weight of the styrene-n-butylmethacrylate copolymer was used as the binder resin, thereby resulting in a melt kneaded matter.

Next, the melt-kneaded matter was rolled under a predetermined condition and cooled off to 12° C. so that toner pellets were obtained. The thickness of the toner pellets was measured by commercial vernier calipers, and the resulting value 1.1 mm was obtained. Thereafter, grinding and classifying processes were carried out in the same manner as Example 1, and colloidal silica was added and mixed with the resulting powder in the same manner as Example 1. Thus, toner 1 having the average particle diameter of 10 $\mu$m was obtained.

Figure 6:
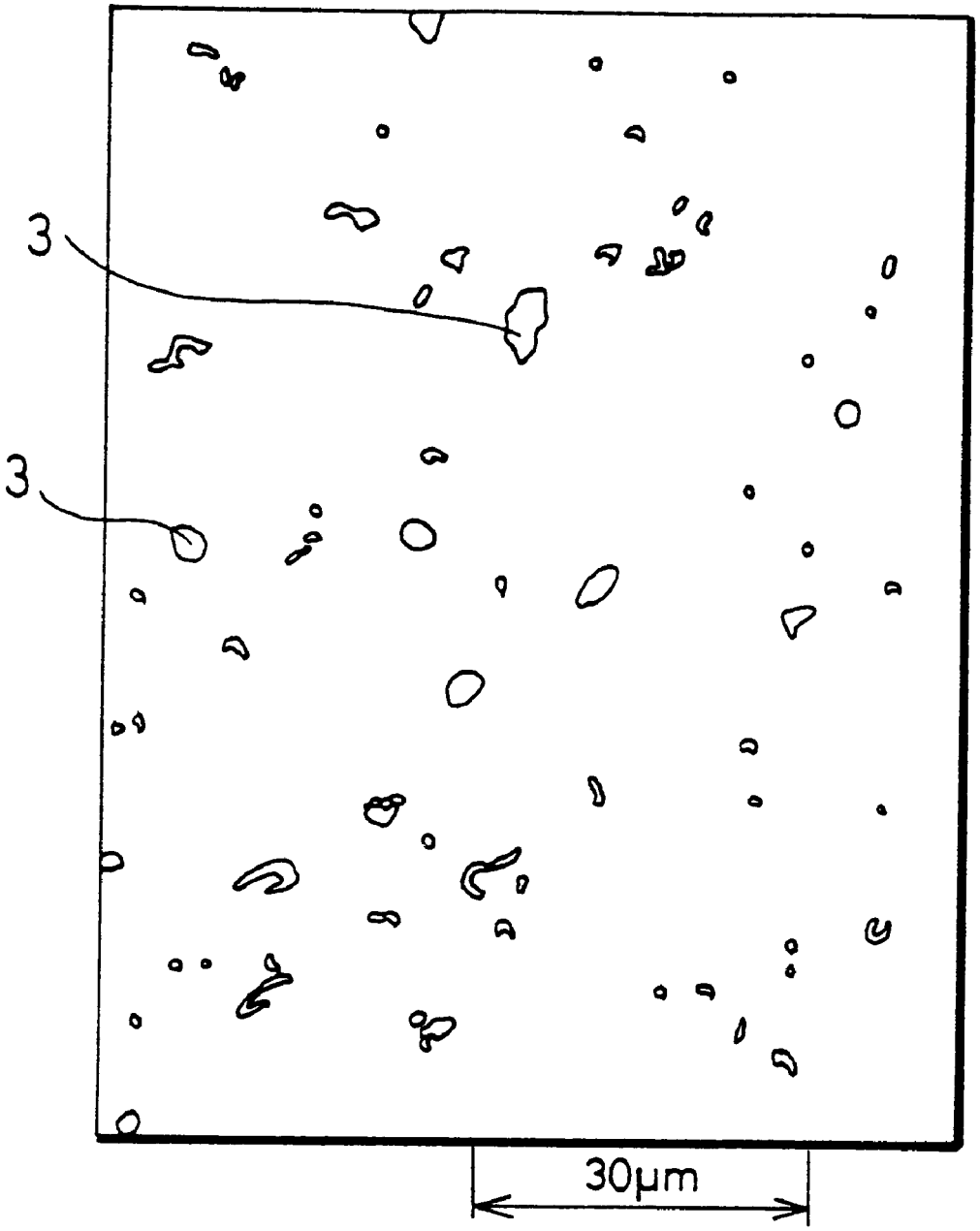
FIG. 6 is a projected plan showing still another example of wax particles contained in the toner of the present invention.

Next, the ratio of major axis/minor axis and the major axis of the wax particles 3 being dispersed in the toner 1 were measured by using electronic-microscopic photographs in the same manner as Example 1. FIG. 6 shows the wax particles 3 shining white on the photograph. Further, the respective tests were carried out on the toner by using the above-mentioned methods. The results of these measurements and tests are shown in Table 1 together with the main manufacturing conditions of the toner.

TABLE 1

| | Exam. 1 | Exam. 2 | Exam. 3 | Exam. 4 | Com. Exam. 1 | Com. Exam. 2 |
|---|---|---|---|---|---|---|
| Ratio of L/S of Wax Particles | 1.0–2.0 | 1.0–3.2 | 1.5–4.0 | 2.5–3.0 | 2.5–4.0 | 1.8–6.0 |
| Major Axis of Wax Particles | 1.0–4.0 | 3.5–6.0 | 4.0–6.0 | 2.3–6.0 | 5.0–12.0 | 4.5–6.0 |
| Amount of Content of Wax Particles (Parts by Weight) | 2.0 | 5.0 | 1.0 | 0.5 | 2.0 | 2.0 |
| Thickness of Toner Pellets (mm) | 1.7 | 2.5 | 1.2 | 3.0 | 0.9 | 1.1 |
| Melt Viscosity of Binding Resin (poise) | 1,300 | 2,000 | 1,100 | 1,000 | 600 | 900 |
| Glass Trans. Temperature of Binding Resin (° C.) | 62 | 63 | 58 | 56 | 60 | 60 |
| Melt Index Value of Binding Resin | 6.0 | 5.0 | 8.0 | 10.5 | 7.4 | 7.4 |

TABLE 1-continued

| | Exam. 1 | Exam. 2 | Exam. 3 | Exam. 4 | Com. Exam. 1 | Com. Exam. 2 |
|---|---|---|---|---|---|---|
| Wax Contamination (sheets) | 130,000 | 120,000 | 100,000 | 90,000 | 20,000 | 30,000 |
| Fixing Cold-Offset | ○ | ○ | ○ | ○ | ○ | ○ |
| Fixing Hot-Offset | ○ | ○ | ○ | ○ | ○ | ○ |
| Grinding Property | ○ | ○ | ○ | ○ | ○ | ○ |

COMPARATIVE EXAMPLE 3

In the present comparative example, styrene-n-butylmethacrylate copolymer was used, in which respective property values of the melt viscosity, the glass transition temperature and the melt index value were 70 Pa·s, 62° C. and 6.8 at 160° C., which were measured in the same manner as Example 1.

Then, mixing and stirring processes and a melt-kneading process were carried out in the same manner as Example 1 except that 100 parts by weight of the styrene-n-butylmethacrylate copolymer was used as the binder resin, thereby resulting in a melt kneaded matter.

Next, the melt-kneaded matter was rolled under a predetermined condition and cooled off to 12° C. so that toner pellets were obtained. The thickness of the toner pellets was measured by commercial vernier calipers, and the resulting value 1.1 mm was obtained. Thereafter, grinding and classifying processes were carried out in the same manner as Example 1, and colloidal silica was added and mixed with the resulting powder in the same manner as Example 1. Thus, toner 1 having the average particle diameter of 10 $\mu$m was obtained.

Figure 7:
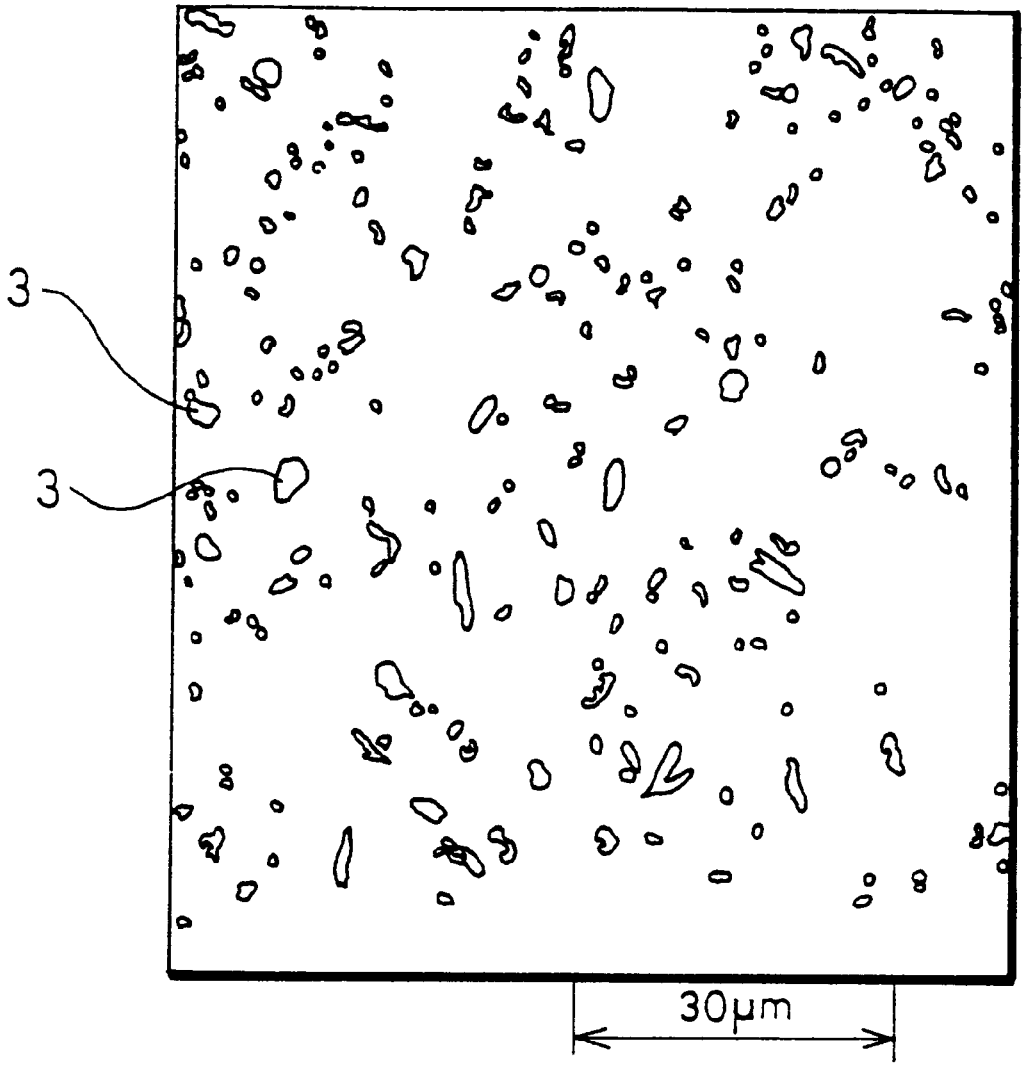
FIG. 7 is a projected plan showing still another example of wax particles contained in the toner of the present invention.

Next, the ratio of major axis/minor axis and the major axis of the wax particles 3 being dispersed in the toner 1 were measured by using electronic-microscopic photographs in the same manner as Example 1. FIG. 7 shows the wax particles 3 shining white on the photograph. Further, the respective tests were carried out on the toner by using the above-mentioned methods. The results of these measurements and tests are shown in Table 2 together with the main manufacturing conditions of the toner.

COMPARATIVE EXAMPLE 4

In the present comparative example, styrene-n-butylmethacrylate copolymer was used, in which respective property values of the melt viscosity, the glass transition temperature and the melt index value were 250 Pa·s, 65° C. and 4.0 at 160° C., which were measured in the same manner as Example 1.

Then, 100 parts by weight of the styrene-n-butylmethacrylate copolymer was used as the binder resin, and mixing and stirring processes and a melt-kneading process were carried out in the same manner as Example 1 except that the amount of use of polyethylene wax was changed from 2 parts by weight to 0.4 parts by weight, resulting in a melt kneaded matter.

Next, the melt-kneaded matter was rolled under a predetermined condition and cooled off to 12° C. so that toner pellets were obtained. The thickness of the toner pellets was measured by commercial vernier calipers, and the resulting value 3.2 mm was obtained. Thereafter, grinding and classifying processes were carried out in the same manner as Example 1, and colloidal silica was added and mixed with the resulting powder in the same manner as Example 1. Thus, toner 1 having the average particle diameter of 10 μm was obtained.

Next, the ratio of major axis/minor axis and the major axis of the wax particles 3 being dispersed in the toner 1 were measured in the same manner as Example 1. Further, the respective tests were carried out on the toner by using the above-mentioned methods. The results of these measurements and tests are shown in Table 2 together with the main manufacturing conditions of the toner.

COMPARATIVE EXAMPLE 5

In the present comparative example, styrene-n-butylmethacrylate copolymer was used, in which respective property values of the melt viscosity, the glass transition temperature and the melt index value were 110 Pa·s, 62° C. and 6.8 at 160° C., which were measured in the same manner as Example 1.

Then, 100 parts by weight of the styrene-n-butylmethacrylate copolymer was used as the binder resin, and mixing and stirring processes and a melt-kneading process were carried out in the same manner as Example 1 except that the amount of use of polyethylene wax was changed from 2 parts by weight to 5.5 parts by weight, resulting in a melt kneaded matter.

Next, the melt-kneaded matter was rolled under a predetermined condition and cooled off to 12° C. so that toner pellets were obtained. The thickness of the toner pellets was measured by commercial vernier calipers, and the resulting value 4.0 mm was obtained. Thereafter, grinding and classifying processes were carried out in the same manner as Example 1, and colloidal silica was added and mixed with the resulting powder in the same manner as Example 1. Thus, toner 1 having the average particle diameter of 10 μm was obtained.

Figure 8:
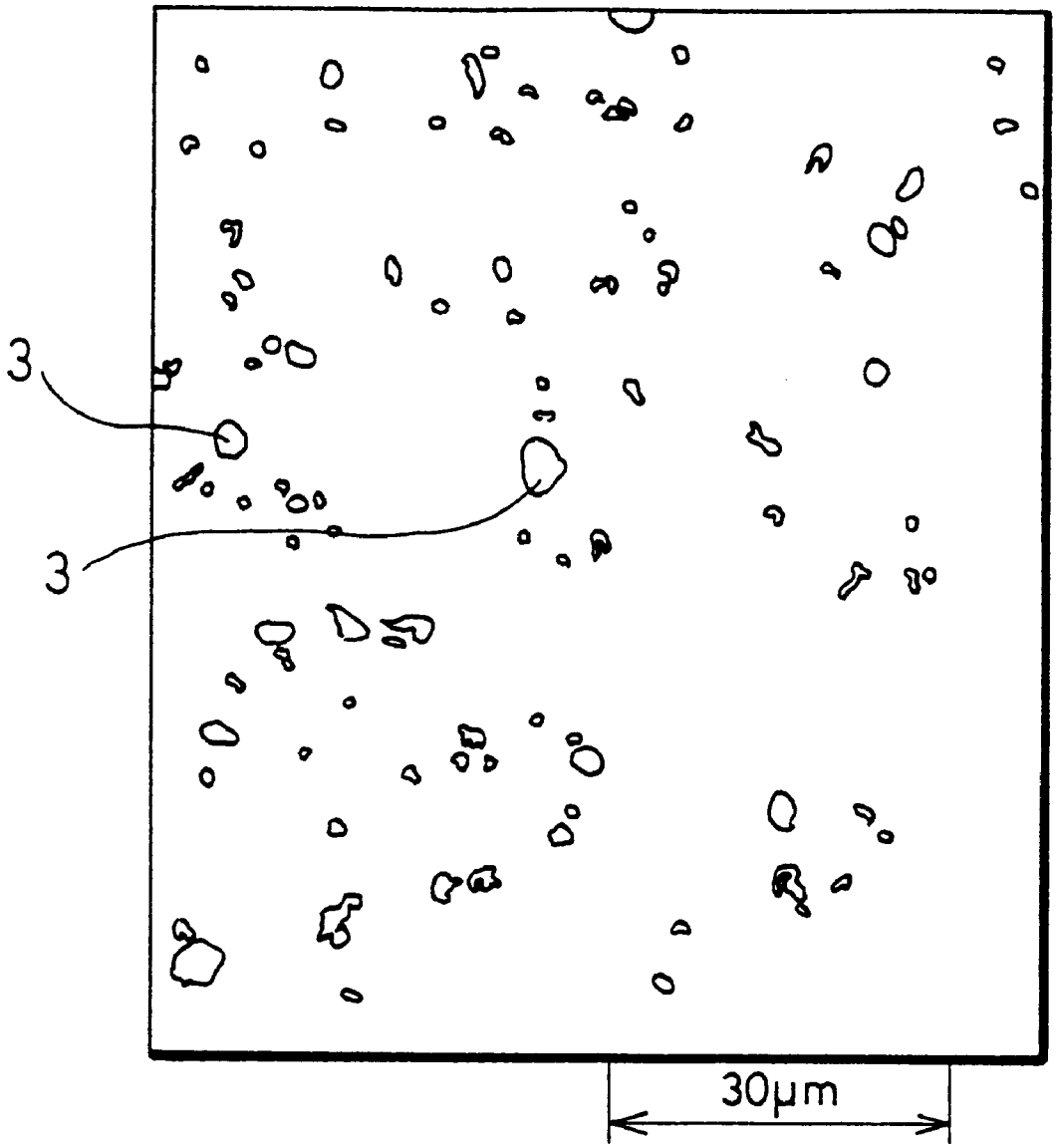
FIG. 8 is a projected plan showing still another example of wax particles contained in the toner of the present invention.

Next, the ratio of major axis/minor axis and the major axis of the wax particles 3 being dispersed in the toner 1 were measured in the same manner as Example 1. FIG. 8 shows the wax particles 3 shining white on the photograph. Further, the respective tests were carried out on the toner by using the above-mentioned methods. The results of these measurements and tests are shown in Table 2 together with the main manufacturing conditions of the toner.

COMPARATIVE EXAMPLE 6

In the present comparative example, styrene-n-butylmethacrylate copolymer was used, in which respective property values of the melt viscosity, the glass transition temperature and the melt index value were 280 Pa·s, 65° C. and 3.5 at 160° C., which were measured in the same manner as Example 1.

Then, 100 parts by weight of the styrene-n-butylmethacrylate copolymer was used as the binder resin, and mixing and stirring processes and a melt-kneading process were carried out in the same manner as Example 1 except that the amount of use of polyethylene wax was changed from 2 parts by weight to 7.0 parts by weight, resulting in a melt-kneaded matter.

Next, the melt-kneaded matter was rolled under a predetermined condition and cooled off to 12° C. so that toner pellets were obtained. The thickness of the toner pellets was measured by commercial vernier calipers, and the resulting value 5.2 mm was obtained. Thereafter, grinding and classifying processes were carried out in the same manner as Example 1, and colloidal silica was added and mixed with the resulting powder in the same manner as Example 1. Thus, toner 1 having the average particle diameter of 10 μm was obtained.

Next, the ratio of major axis/minor axis and the major axis of the wax particles 3 being dispersed in the toner 1 were measured in the same manner as Example 1. Further, the respective tests were carried out on the toner by using the above-mentioned methods. The results of these measurements and tests are shown in Table 2 together with the main manufacturing conditions of the toner.

COMPARATIVE EXAMPLE 7

In the present comparative example, styrene-n-butylmethacrylate copolymer was used, in which respective property values of the melt viscosity, the glass transition temperature and the melt index value were 100 Pa·s, 53° C. and 12.0 at 160° C., which were measured in the same manner as Example 1. Then, 100 parts by weight of the styrene-n-butylmethacrylate copolymer was used as the binder resin, and mixing and stirring processes and a melt-kneading process were carried out in the same manner as Example 1 except that the amount of use of polyethylene wax was changed from 2 parts by weight to 2.5 parts by weight, resulting in a melt-kneaded matter.

Next, the melt-kneaded matter was rolled under a predetermined condition and cooled off to 12° C. so that toner pellets were obtained. The thickness of the toner pellets was measured by commercial vernier calipers, and the resulting value 1.2 mm was obtained. Thereafter, grinding and classifying processes were carried out in the same manner as Example 1, and colloidal silica was added and mixed with the resulting powder in the same manner as Example 1. Thus, toner 1 having the average particle diameter of 10 μm was obtained.

Figure 9:
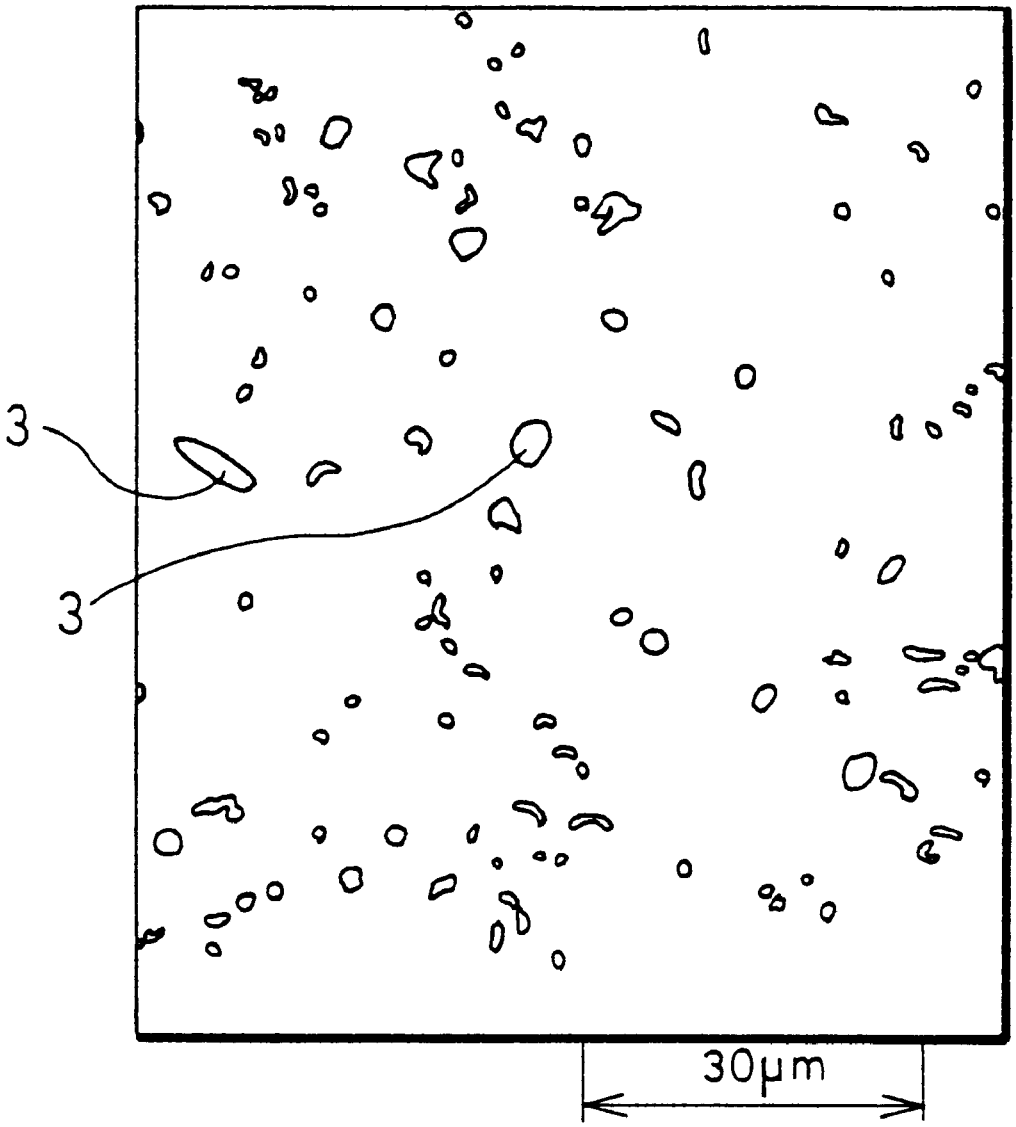
FIG. 9 is a projected plan showing still the other example of wax particles contained in the toner of the present invention.

Next, the ratio of major axis/minor axis and the major axis of the wax particles 3 being dispersed in the toner 1 were measured in the same manner as Example 1. FIG. 9 shows the wax particles 3 shining white on the photograph. Further, the respective tests were carried out on the toner by using the above-mentioned methods. The results of these measurements and tests are shown in Table 2 together with the main manufacturing conditions of the toner.

TABLE 2

| | Comp. Exam.3 | Comp. Exam.4 | Comp. Exam.5 | Comp. Exam.6 | Com. Exam.7 |
|---|---|---|---|---|---|
| Ratio of L/S of Wax Particles | 4.5–6.0 | 2.5–3.2 | 1.5–4.0 | 1.5–4.0 | 1.5–4.0 |
| Major Axis of Wax Particles | 5.5–10.0 | 2.0–6.2 | 2.7–6.4 | 2.0–6.9 | 4.0–8.0 |

TABLE 2-continued

| | Comp. Exam.3 | Comp. Exam.4 | Comp. Exam.5 | Comp. Exam.6 | Com. Exam.7 |
|---|---|---|---|---|---|
| Amount of Content of Wax Particles (Parts by Weight) | 2.0 | 0.4 | 5.5 | 7.0 | 2.5 |
| Thickness of Toner Pellets (mm) | 1.1 | 3.2 | 4 | 5.2 | 1.2 |
| Melt Viscosity of Binding Resin (poise) | 700 | 2,500 | 1,100 | 2,800 | 1,000 |
| Glass Trans. Temperature of Binding Resin (° C.) | 62 | 65 | 62 | 65 | 53 |
| Melt Index Value of Binding Resin | 6.8 | 4.0 | 6.8 | 3.5 | 12.0 |
| Wax Contamination (sheets) | 30,000 | 60,000 | 40,000 | 70,000 | 20,000 |
| Fixing Cold-Offset | ○ | x | ○ | x | x |
| Fixing Hot-Offset | ○ | x | ○ | ○ | x |
| Grinding Property | ○ | x | x | x | ○ |

As clearly shown by the results in Table 1 and Table 2 , it was found that the toners of the present examples made it possible to suppress wax contamination on the surface of the toner-bearing body as compared with the comparative examples. Further, the toners of the present examples also made it possible to prevent cold-offset and hot-offset during the fixing process, and also to achieve a superior grinding property.

(EMBODIMENT 2)

The following description will discuss another embodiment of the present invention.

As illustrated in FIG. 1, toner 1 of the present embodiment, which serves as electrophotographing toner, contains binder resin 2 in particles that is a thermoplastic resin and 1 to 10 parts by weight of wax particles 3 serving as a mold-releasing agent and a lubricant, and also contains a charge-controlling agent, 1 to 10 parts by weight of coloring agent, and externally additive agents such as hydrophobic silica and magnetite. Here, the charge-controlling agent, coloring agent and wax particles 3 are contained inside the binder resin 2 as additive agents in a dispersed form as particles finer than the binder resin 2.

The method for preparing such toner 1 is described as follows: First, binder resin 2 such as styrene-n-butylmethacrylate copolymer, a charge-controlling agent such as nigrosin die, a coloring agent such as carbon black having a conductive property and wax particles 3 such as wax of the polyolefin family were mixed to obtain a mixture, and then the mixture was melt-kneaded by a kneader with heat being applied thereto, thereby obtaining a kneaded matter. Successively the kneaded matter was rolled and cooled off, and the resulting plate-shaped matter that has been rolled and cooled off were ground and classified so as to obtain particle-shaped matter. Then, the above-mentioned externally additive agent was added to the surface of the particle-shaped matter, resulting in toner 1.

Here, the melt index (hereinafter, referred to as MI value) of the binder resin 2 is set in the range of 5.0 to 11.0, more preferably set in the range of 5.5 to 10.0, and most preferably set in the range of 6.0 to 8.0.

By setting the melt index of the binder resin 2 in the range of 5.0 to 11.0 as described above, it becomes possible to knead the melt-kneading matter with a higher viscosity. In this kneaded matter, since the melted binder resin 2 exerts a greater shearing force on the wax particles 3 inside the binder resin 2; therefore, it is possible to disperse the wax particles 3 inside the binder resin 2 as finer particles.

The smaller the MI value of the binder 2, the greater its viscosity. The MI value of not more than 11.0 allows the wax particles to be sufficiently dispersed inside the binder resin 2. However, the MI value of less than 5.0 makes the viscosity of the binder resin 2 too high during the kneading process, with the result that a very large shearing force is exerted also on the binder resin 2, thereby cutting polymer chains of the binder resin 2. For this reason, the molecular weight of the binder resin 2 is reduced, and since this causes the viscosity of the melted toner 1 to reduce when it is melted during the transferring process, an offset phenomenon tends to occur more easily during the fixing process.

In addition, in the toner 1 thus obtained, the coloring agent is dispersed inside the binder resin 2 in such a manner that the dielectric loss tangent (tan δ) is set at not more than 5.0 and not less than 2.0, more preferably set at not more than 4.5 and not less than 2.5, and most preferably set at not more than 4.0 and not less than 3.0.

Here, in the same manner as the wax particles 3, the coloring agent differs greatly in its dispersed state inside the binder resin 2 depending on melt-kneading conditions or rolling and cooling conditions. In the case when the coloring agent is not dispersed preferably inside the binder resin 2, it easily re-aggregates to form secondary particles; this causes instability in the charging property such as reduction in the charging property.

In other words, since the coloring agent is a conductive material, it causes a reduced value of resistance in the resulting toner 1 when its dispersing property inside the binder resin 2 deteriorates, thereby increasing tan δ in the toner 1. Tan δ exceeding 5.0 reduces the quantity of charge in the resulting toner 1, resulting in problems such as toner scattering and fog. Tan δ of less than 2.0, on the other hand, increases the quantity of charge too much, resulting in problems such as degradation in the image density during the transferring process. The value of tan δ is greatly influenced by the dispersed state of the conductive coloring agent inside the binder resin 2.

Therefore, in the toner 1 of the present invention, the MI value of the binder resin 2 is set as described earlier, and the value of tan δ is also set as described above; consequently, it becomes possible to ensure superior image quality in which the value of fog is reduced to, for example, not more than 1.5 during the transferring process, even after the toner has been stored or left for two days under a high temperature, for example, at 50° C., as will be described later.

Moreover, the above-mentioned toner 1 was obtained by adjusting the setting of the outlet temperature during the melt-kneading process to a temperature that allows the binder resin 2 to have a melt viscosity of not less than 100

Pa·s, when the mixture of the binder resin 2, the coloring agent and the wax particles 3 were melt-kneaded.

In this manner, by adjusting the setting of the outlet temperature of the kneading matter to a temperature that allows the binder resin 2 to have a melt viscosity of not less than 100 Pa·s upon obtaining the toner 1, the melted binder resin 2 is allowed to exert a higher shearing force on the wax particles 3 in the binder resin 2. For this reason, the wax particles 3, such as wax of the polyolefin family, for example, polyethylene wax, are preferably dispersed inside the binder resin 2 as fine particles. The higher the melt viscosity of the binder resin 2, the finer particles the wax particles 3 are allowed to make and to be scattered.

Thus, in the toner 1, the setting of the outlet temperature of the melt-kneader is adjusted at a temperature that allows the binder resin 2 to have a melt viscosity of not less than 100 Pa·s and not more than 1000 Pa·s, and the value of tan δ is set as described above; this makes it possible to provide control so as to improve the dispersing property of the additive agents such as the wax particles 3 located inside the binder resin 2 in a mixed manner. Consequently, it becomes possible to ensure superior image quality in which the value of fog is reduced to, for example, not more than 1.5 during the copying process, even after the toner has been stored or left for two days under a high temperature, for example, at 50° C., as will be described later.

Moreover, in the toner 1, when, after the kneaded matter has been obtained by melt-kneading the mixture of the binder resin 2, the coloring agent and the wax particles 3, the kneaded matter is rolled and cooled off, the thickness of the matter that has been rolled and cooled off is set in the range of 1.2 to 3 mm, more preferably in the range of 1.3 to 2.5 mm, and most preferably in the range of 1.4 to 2.2 mm.

In the above-mentioned kneaded matter, during the binder resin 2 is cooled to the glass transition temperature, the coloring agent contained inside the binder resin 2 tends to re-aggregate to form secondary particles. Therefore, in order to maintain a good charging property by improving the dispersing state of the additive agents such as the coloring agent inside the binder resin 2, it is necessary to cool the kneaded matter having the coloring agent in a dispersed manner, obtained through the melt-kneading process, very quickly, that is, at a cooling rate of not less than 10° C./sec. The thicker the thickness of the kneaded matter after the rolling and cooling process, the more effectively it is cooled off; thus, a sufficient quick-cooling effect is expected by setting the thickness at not less than 1.2 mm. However, when the thickness of the kneaded matter after the rolling and cooling process exceeds 3 mm, it becomes difficult to grind and classify the kneaded matter that has been rolled and cooled off.

For this reason, in the toner 1, the cooling and rolling rate is controlled as described above by setting the thickness of the kneaded matter at the time of rolling and cooling in the range of 1.2 to 3 mm so as to improve the quick cooling effect.

In this manner, in the toner 1, the thickness of the kneaded matter at the time of rolling and cooling is limited to the range of 1.2 to 3 mm, and the value of tan δ is set as described above; this makes it possible to provide control so as to improve the dispersing property of the wax particles 3 and the coloring agent located inside the binder resin 2 in a mixed manner.

As described above, the toner 1 makes it possible to ensure superior image quality in which the value of fog is reduced to, for example, not more than 1.5 during the copying process, even after the toner has been stored or left for two days under a high temperature, for example, at 50° C., as will be described later.

Moreover, in the toner 1, the binder resin 2 to be used is set at not less than 55° C. and not more than 62° C. in its glass transition temperature (Tg). As described earlier, it is necessary to quickly cool off the obtained kneaded matter to the glass transition temperature of the binder resin 2. Therefore, the cooling time can be shortened by regulating the glass transition temperature (Tg) of the binder resin 2 to not less than 55° C., thereby making it possible to improve the dispersing property of the additive agents such as the coloring agent so as to be properly dispersed inside the binder resin 2.

In this manner, in the toner 1, the glass transition temperature of the binder resin 2 is regulated as described above, and the value of tan δ is set as described earlier; this makes it possible to provide control so as to improve the dispersing property of the wax particles 3 and the coloring agent located inside the binder resin 2 in a mixed manner.

As described above, the toner 1 makes it possible to ensure superior image quality in which the value of fog is reduced to, for example, not more than 1.5 during the copying process, even after the toner has been stored or left for two days under a high temperature, for example, at 50° C., as will be described later.

Furthermore, in the toner 1, the diameter of the wax particles 3 dispersed inside the binder resin 2 is designed in such a manner that the ratio of major axis L/minor axis S in the average values in cross-sectional projection is set in the range of 1.0 to 4.0, more preferably in the range of 1.0 to 3.5, and most preferably in the range of 1.0 to 3.0.

The dispersed state of the additive agents, such as the wax particles 3, dispersed inside the binder resin 2 is determined depending on melt-kneading conditions, rolling and cooling conditions, etc. The wax particles 3, dispersed inside the binder resin 2 as fine particles, tend to separate if they are not sufficiently dispersed by a large shearing force which is attained from a high viscosity; in the case of such a separated state, a kneaded matter, in which the wax particles 3 having a thin, long shape with a greater ratio of major axis/minor axis are dispersed, is obtained. Toner 1 obtained from such a kneaded matter tends to cause fog, etc., resulting in degradation in the image quality during the copying process.

Therefore, in the toner 1, the diameter of the wax particles 3 dispersed inside the binder resin 2 is set as described above so that the dispersed state of the wax particles 3 is controlled, and the value of tan δ is set as described earlier; this makes it possible to provide control so as to improve the dispersing property of the wax particles 3 and the coloring agent located inside the binder resin 2 in a mixed manner. As described above, the toner 1 makes it possible to ensure superior image quality in which the value of fog is reduced to, for example, not more than 1.5 during the copying process, even after the toner has been stored or left for two days under a high temperature, for example, at 50° C., as will be described later.

Next, an explanation will be given of the measuring method of the MI value of the present specification. The MI value is also referred to as the melt flow rate. The MI value is measured based upon JIS K-7210, DIN 53 735 or ASTM D-1238-57T. For example, by using an MI value measuring device (Name: Melt Indexer, manufactured by Toyo Seiki Co., Ltd., having a cylinder inner diameter of ϕ9.5±0.01 mm, a piston outer diameter of ϕ9.48×0.01 mm and a piston length of 175 mm) and 8 g of a sample (density: 0.980 g/cm$^3$), the amount of extrusion per ten minutes, which has been extruded from a die (orifice) (having an inner diameter of 2.095±0.005 mm and a length of 8.0±0.025 mm) when a load of 2160 g is applied to the piston at a temperature of 150° C., is measured, and the MI value is calculated based upon the amount of extrusion.

The following equation is used for the calculation:

$$MI(\text{g/10 minutes}) = \frac{426 \times L \times d}{t}$$

where

L=the length of the piston movement (cm), d=the density of the sample at the test temperature ($g/cm^3$), t=the time required for the piston to move the length L (sec.), and 426=(the average area value of the piston and the cylinder)×600.

Next, the following description will discuss the measuring method of the dielectric loss tangent (tan δ). First, the resulting toner was made into a sample having a size of approximately 1.5 mm for use in measurements of tan δ by a tablet-forming device, and this sample was measured by a dielectric-loss measuring device (TRS-10T TYPE, manufactured by Ando Electric Co., Ltd.) so as to calculate tan δ.

With respect to the operation method of the measuring method, the test sample is first attached to the inside of an electrode for solid body, and the electrode is plugged in a constant temperature bath. Then, the measuring mode of the measuring device is set at the zero-balance mode, and a balance operation is carried out by determining the RATIO value in accordance with a measured frequency. At this time, the value of conductance is defined as R0. Further, after changing the measuring mode, a balance operation is carried out in the same manner as the zero balance. At this time, the capacitance is defined as Cx and the conductance is defined as R'. Tan δ is calculated as follows by using the above-mentioned measuring values.

$$\text{First, dielectric constant}(\in') = Cx/C0 \quad (1)$$

Here, C0 is a geometrical electrostatic capacitance which is an electrostatic capacitance obtained by replacing the dielectric with air.

On the other hand, the dielectric-loss constant (∈") is found from the following equation:

$$\text{Dielectric-loss constant}(\in'') = Gx/\omega C0 \quad (2)$$

Here, ω is an angular frequency, and represented by ω=2πf (f is a frequency Hz), and Gx is a conductance, and represented by Gx=RATIO value×(R'−R0).

Further, tan δ is represented by:

$$\tan\delta = \in''/\in' \quad (3).$$

When equation (1) and equation (2) are substituted in equation (3), tan δ is represented by:

Gx/ωCx=RATIO value×(R'−R0)/2πfCx, and tan δ is measured by respectively substituting measured values. In the above-mentioned measuring method, the measuring frequency was 1 kHz, and the corresponding RATIO value was $1\times10^{-9}$.

Next, an explanation will be given of a method for estimating fog. First, after the resulting toner had been left at a high temperature of 50° for two days, fog were estimated by using an actual copying machine (SD2260, manufactured by Sharp Corporation).

The method for estimating fog is described as follows: First, white paper of A-4 size is preliminarily measured in its whiteness by using a whiteness-measuring device (Hunter whiteness-measuring device, manufactured by Nippon Denshoku Kogyo Co., Ltd). The resulting whiteness is defined as the first measured value. Next, copies are made on 10 sheets of the above-mentioned white paper by using an original document containing a circle measuring 55 mm in radius, and the white portions of the resulting sample copies are again measured by the above-mentioned whiteness-measuring device. The whitenesses at this time are defined as the second measured values. Successively, values obtained by subtracting the second measured values from the first measured value are defined as values of fog. The evaluation of fog is carried out by using the average value of the values of fog obtained from the 10 sheets of paper.

Next, the following description will discuss specific examples of the electrophotographing toner of the present invention.

TABLE 3

| | |
|---|---|
| Styreneacryl Copolymer Resin | 100 parts by wt. |
| Carbon black | 7.0 parts by wt. |
| Charge-Controlling Agent | 2.0 parts by wt. |
| Polyethylene Wax | 1.0 part by wt. |

EXAMPLE 5

Styreneacryl copolymer resin serving as the binder resin 2 had an MI value of 6.8, and respective materials described in Table 3 were mixed by a Henschel mixer, resulting in a mixture. Next, the mixture was melt-kneaded by a continuous-type two-shaft extrusion kneader, thereby obtaining a kneaded matter, and then the kneaded matter was rolled and quickly cooled off, that is, at a cooling-rate of 14° C./sec, and subjected to grinding and classifying processes, thereby obtaining toner main particles having the average particle diameter of 10 μm. Further, 100 parts by weight of the toner main particles were mixed with 0.35 parts by weight of hydrophobic silica and 0.2 parts by weight of magnetite powder, both serving as external additive agents, and stirred by a supermixer so as to externally add these agents, thereby obtaining black toner 1 in particles as Sample 1.

On the other hand, the cooling process of the above-mentioned melt-kneaded matter was set so as to have a cooling rate of 6.0° C./sec. that was slower than the cooling rate of Sample 1; thus, toner whose tan δ was set at not less than 5.0 was produced as Comparative Sample 1.

Moreover, Comparative Sample 2 was produced in the same manner as Example 5 except that styreneacryl copolymer resin having an MI value of 13.1 was used. With respect to these Sample 1 and Comparative Samples 1 and 2, fog is evaluated in accordance with the aforementioned evaluating method. The results of the evaluation are shown in Table 4.

TABLE 4

| | MI Value | Tan δ | Fog(Ave.) | Fog Evalua. |
|---|---|---|---|---|
| Sample 1 | 6.8 | 3.77 | 0.78 | ○ |
| Com.Sam.1 | 6.8 | 5.32 | 3.09 | x |
| Com.Sam.2 | 13.1 | 3.75 | 2.12 | Δ |

In the above Table, "○" indicates a good evaluation in fog, "x" indicates poor and "Δ" indicates slightly poor. Moreover, in the following tables, fog is evaluated in the same manner. In the following tables, "xx" indicates a completely poor evaluation in fog.

First, in the case of MI values of less than 5.0, an offset phenomenon occurs due to a reduction in the molecular weight of the binder resin 2, causing a great fog value at room temperature and the subsequent degradation in the image quality, as described earlier; therefore, the above-mentioned tests were not carried out.

Moreover, as clearly explained by the results shown in Table 4, in the case of MI values exceeding 11.0, the dispersed state of the polyethylene wax mixed in the binder resin 2 deteriorates, the polyethylene wax is separated outside the toner particles, and the fluidity and charging property deteriorate. For this reason, when toner after having been left under high temperatures was evaluated by using the copying machine, the fog value became greater regardless of the value of tan δ.

Furthermore, even in the case when the MI value of styreneacryl copolymer resin was set in the range 5.0 to 11.0, since the dispersed state of carbon black is changed merely by a different cooling condition in the toner manufacturing process, the quantity of charge in the resulting toner was reduced when the value of tan δ exceeded 5.0, causing a higher fog value and the subsequent deterioration in the image quality, as shown in Comparative Sample 1.

On the other hand, as shown in Sample 1, when the value of tan δ was set at not more than 5.0, the fog value was greatly reduced as compared with Comparative Samples 1 and 2 so that the quality of the copied image was improved. Therefore, in the present invention, the MI value of the binder resin 2 is set in the range 5.0 to 11.0 and the cooling condition, etc. are arranged so as to set the value of tan δ at not more than 5.0; thus, it becomes possible to effectively prepare toner 1 that can be stored even under high temperatures.

EXAMPLE 6

With respect to styreneacryl copolymer resin 2 (MI value 6.8) serving as the binder resin 2 of the present invention, temperatures at which the melt viscosity of the styreneacryl copolymer resin were respectively set at not less than 100 Pa·s and at less than 100 Pa·s were measured by a viscosimeter (flow tester, CFT500, manufactured by Shimadzu Seisakusho Ltd) by using 1 g of the sample. Measuring conditions such as, for example, a rate of temperature increase of 6° C./min, a starting temperature of 80° C., a preheating time of 300 sec., a die of 0.5 mm×1 mm and a pressure of 5 kg/cm$^2$ were used.

As a result, at 190° C. the styrene acrylcopolymer resin had a melt viscosity of 80 Pa·s that was less than 100 Pa·s, and at 150° C. it had a melt viscosity of approximately 800 Pa·s that exceeded 100 Pa·s.

The melt viscosity was measured by using the viscosity measuring method stipulated in JIS K-7210 (the flow property test) through a heating method for resin materials as described below.

First, the resin sample loaded into a cylinder was pushed and solidified by the piston, and was then subjected to the pre-heating process at the starting temperature of 80° C. for the preheating time (300 seconds), and after the pre-heating time, the resin sample was extruded from the die of cylinder by the piston with a predetermined pressure (5 kg/cm$^2$) while being heated to 300° C. with a linear temperature increase (6° C./minute); thus, the amount of extrusion, that is, changes in the amount of stroke (mm) of the piston with time, (at each temperature) were successively measured.

The melt viscosity of the resin sample at each temperature was calculated based upon the change of rate in the amount of stroke at each temperature, for example, based upon the inclination at a position corresponding to each temperature when the change in the amount of stroke (mm) of the piston was plotted on a graph.

Next, Sample 2 of the toner 1 was produced in the same manner as example 5 except that the outlet setting temperature of the melt kneader was set at 150° C. Moreover, Sample 3 of the toner 1 was produced while the cooling conditions upon producing Sample 2 were changed in the same manner as Example 5.

Moreover, Sample 4 of the toner 1 was produced in the same operation as Example 5 except that the outlet setting temperature of the melt kneader was set at 190° C. in Example 5. With respect to Sample 3 and Comparative Samples 3 and 4, the fog value was measured in accordance with the evaluation method of fog as described earlier. The results are shown in Table 5.

TABLE 5

| | Set Temp | Tan δ | Fog(Ave.) | Fog Evalua. |
|---|---|---|---|---|
| Sample 2 | 150° C. | 3.77 | 0.78 | ○ |
| Com.Sam.3 | 150° C. | 5.22 | 2.52 | Δ |
| Com.Sam.4 | 190° C. | 3.64 | 1.98 | Δ |

As clearly explained by the results shown in Table 5, even if the melt-kneading process was carried out under a temperature condition (190° C.) at which the binder resin 2 had a melt condition of less than 100 Pa·s, it was difficult to sufficiently disperse the polyethylene wax in the resin. Therefore, in the same manner as Example 5, when the toner, after having been left under high temperatures, was evaluated by using the actual copying machine, the fog value increased, resulting in degradation in the quality of the copied image.

On the other hand, when the melt-kneading process was carried out under a temperature condition (150° C.) at which the binder 2 had a melt viscosity of not less than 100 Pa·s, the polyethylene wax was dispersed in the binder resin 2 as fine particles.

However, even in the case when the outlet setting temperature was set at a temperature at which the melt viscosity of the toner became not less than 100 Pa·s, since the dispersed state of carbon black is changed merely by a different cooling condition in the toner manufacturing process, the quantity of charge in the resulting toner was reduced when the value of tan δ exceeded 5.0, causing a higher fog value and the subsequent deterioration in the image quality, as shown in Comparative Sample 3.

On the other hand, as shown in Sample 2, when the value of tan δ was set at not more than 5.0, the fog value was greatly reduced as compared with Comparative Samples 3 and 4 so that the quality of the copied image was improved. Therefore, in the present invention, the melt-kneading process is carried out at a temperature condition at which the binder resin 2 to be used has a melt viscosity of not less than 100 Pa·s and the cooling condition, etc. are arranged so as to set the value of tan δ at not more than 5.0; thus, it becomes possible to effectively prepare toner 1 that can be stored even under high temperatures and has high quality in the copied image.

EXAMPLE 7

Toner was produced by using the same ingredients shown in Table 3 in accordance with the same method as Example 6. In this case, the conditions of the melt-kneading process were changed and the pressure of the rolling and cooling processes was changed. The thicknesses of the kneaded matter were measured by a micrometer, and values 1.0 mm and 1.7 mm were obtained.

Toner 1 having the thickness of 1.7 mm, obtained under the same melt-kneading conditions as Example 6, was used as Sample 3, toner 1 having the thickness of 1.7 mm, obtained through different melt-kneading conditions, was used as Sample 5, and toner 1 having the thickness of 1.0 mm was used as Sample 6. The fog value was measured in each of the samples, and the results were collectively shown in Table 6.

TABLE 6

| | Thickness (mm) | Tan δ | Fog(Ave.) | Fog Evaluation |
|---|---|---|---|---|
| Sample 3 | 1.7 | 3.77 | 0.78 | ○ |
| Com.Sam.5 | 1.7 | 5.73 | 5.66 | x |
| Com.Sam.6 | 1.0 | 5.23 | 4.38 | x |

First, setting the thickness of the kneaded matter after the rolling and cooling processes at a great value exceeding 3 mm makes the grinding and classifying processes very difficult, making it virtually impossible to produce toner; therefore, this test was not carried out.

As clearly explained by the results shown in Table 6, when the rolling and cooling processes are carried out under conditions as shown in Comparative Sample 6 in which the thickness of the kneaded matter becomes less than 1.2 mm, carbon black tends to form secondary particles. Therefore, the resulting Sample 6 has an instable charging property, failing to provide a stable image quality.

Moreover, even if the rate of rolling and cooling processes is increased by setting the thickness of the kneaded matter at not less than 1.2 mm as shown in Comparative Sample 5, the value of tan δ exceeds 5.0 unless the kneaded matter is cooled off with the carbon black sufficiently dispersed therein, with the result that merely toner having an instable charging property and causing much fog is obtained.

In contrast, toner in which the thickness of the kneaded matter was set at not less than 1.2 mm and the tan δ was set at not more than 5.0 as shown in Sample 3 had a greatly reduced value as compared with Samples 5 and 6. Therefore, conditions, in which the thickness of the kneaded matter after the rolling and cooling processes is set in the range of 1.2 to 3 mm so as to provide quick cooling in the rolling and cooling process as well as setting tan δ at not more than 5.0, with the binder resin 2 allowing the carbon black to be sufficiently dispersed therein, make it possible to prevent degradation in the copied image quality of the toner that tends to be left under high temperatures, and have proved to be effective to the toner.

EXAMPLE 8

Toner was produced by using the same ingredients shown in Table 3 in accordance with the same method as Example 6. In this case, two kinds of styreneacryl copolymer resin to be used were measured by using a thermal analyzer (manufactured by Seiko Electronic Co., Ltd.) in their glass transition temperatures (Tg), and the resulting values of 57.2° C. and 53.8° C. were obtained.

Sample 4 of the toner 1 of the present invention was obtained by using the styreneacryl copolymer resin whose Tg was 57.2° C. and setting the melt-kneading condition at 150° C. as described in Example 6.

Comparative Sample 7 was produced in the same manner as Example 8 except that the melt-kneading condition was set at 190° C. Moreover, Comparative Sample 8 was produced by using the same operation as Example 8 except that the styreneacryl copolymer resin whose Tg was 53.8° C. was used. These Sample 4 and Comparative Samples 7 and 8 were respectively evaluated in accordance with the evaluation method described in the aforementioned Example 5.

TABLE 7

| | Tg (° C.) | Tan δ | Fog(Ave.) | Fog Evaluation |
|---|---|---|---|---|
| Sample 4 | 57.2 | 3.77 | 0.78 | ○ |
| Com.Sam.7 | 57.2 | 5.43 | 4.66 | x |
| Com.Sam.8 | 53.8 | 5.02 | 2.38 | Δ |

As clearly explained by the results in Table 7, in the case when a binder resin 2 whose Tg is less than 55° C. is used, even if polyethylene wax and a coloring agent are dispersed in the binder resin 2, the time during which the glass transition state allows carbon black to aggregate to form secondary particles increases, as shown by Comparative Sample 8. For this reason, since the amount of the secondary particles formed in the carbon black increases, the charging property of the resulting toner becomes instable, failing to provide stable image quality.

In contrast, as indicated by Comparative Sample 7, even if the time during which the glass transition state is maintained is reduced by using a binder resin 2 whose Tg is not less than 55° C., unless the kneaded matter is cooled off with the carbon black being sufficiently dispersed in such a melt-kneading condition as 190° C., the resulting toner 1 comes to have a tan δ exceeding 5.0, resulting in an instable charging property and causing much fog.

As indicated by Sample 4, toner 1, which uses a binder resin 2 whose Tg is not less than 55° C. and has a tan δ of not more than 5.0, makes it possible to reduce the value of fog to a great degree as compared with Comparative Samples 7 and 8. Therefore, the condition in which the binder resin whose Tg is not less than 55° C. is used and tan δ is set at not more that 5.0 is effective to toner 1 that tends to be stored under high temperatures.

EXAMPLE 9

Sample 5 of toner was produced by using the same ingredients shown in Table 3 in accordance with the same method as Example 6. Moreover, Comparative Sample 9 of toner was produced in the same operation as that of Sample 5 except that the melt-kneading condition in the manufacturing process is changed in the same manner as described in Example 6. Furthermore, Comparative Sample 10 of toner was produced in the same operation as that of Sample 5 except that the cooling condition in the manufacturing process is changed in the same manner as described in Example 7.

Measurements of the diameter of polyethylene wax particles dispersed in toner particles.

Each of the samples of three kinds thus produced was weighed by 3 mg, and diluted by ten times its volume of tetrahydrofuran (THF). The diluted solution was separated by a centrifuge, and then the supernatant liquid was obtained and filtered. After the filtration, polyethylene wax remains on the filter paper, a metal film was formed on the polyethylene wax by means of vapor deposition through spattering, and then the shape of the polyethylene wax was observed by a scanning-type electronic microscope (manufactured by Hitachi, Ltd.) through the metal film. Further, the ratio of major axis/minor axis of the polyethylene wax in a dispersed state was measured, and the resulting ratio of major axis/minor axis was 1.59 in Sample 5, 5.21 in Sample 9, and 1.20 in Comparative Sample 10. Only the melt-kneading condition is different between Sample 5 and Comparative Sample 9, and only the cooling condition is different between the Sample 5 and Comparative Sample 10.

TABLE 8

| | L / S | Tan δ | Fog(Ave.) | Fog Evaluation |
|---|---|---|---|---|
| Sample 5 | 1.59 | 3.77 | 0.78 | ○ |
| Com.Sam.9 | 5.21 | 5.88 | 5.66 | x |
| Com.Sam.10 | 1.59 | 20.95 | 33.57 | xx |

As clearly explained by Table 8, as shown in Comparative Sample 10, even in the case when the melt-kneading process is carried out under a condition in which the dispersing property of polyethylene wax can be improved, unless the cooling rate is set beyond a predetermined value, the dispersing property of carbon black is bad although the dispersed state of polyethylene wax is good, with the result that tan δ exceeds 5.0 to a great degree, causing instability in the charging property and much fog in the resulting toner. Only the cooling condition is different between Comparative Sample 10 and Sample 5, and the ratio of major axis/minor axis of polyethylene wax is good in both of the samples. However, since the cooling rate of Comparative Sample 10 is slow, the carbon black re-aggregates, resulting in much fog in the toner.

Moreover, as shown in Comparative Sample 9, even in the case when the cooling rate is increased, the polyethylene wax and carbon black are not sufficiently dispersed unless the melt-kneading process is carried out under a strong-kneading condition, with the result that tan δ exceeds 5.0, causing instability in the charging property and much fog in the resulting toner.

In contrast, toner such as Sample 5, in which the ratio of major axis/minor axis of the polyethylene wax was set in the range of 1 to 3 and tan δ was set at not more than 5.0, made it possible to reduce fog to a great degree, as compared with Comparative Samples 9 and 10. Therefore, the condition, in which the ratio of major axis/minor axis of the polyethylene wax, which indicates the dispersed state of the polyethylene wax, is set in the range of 1 to 3 and tan δ is set at not more than 5.0, makes it possible to prevent degradation in the copied image quality of the toner that tends to be left under high temperatures, and has proved to be effective for use in the toner.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrophotographing toner, which is obtained by grinding a kneaded matter that was obtained by melt-kneading the binder resin and the mold-releasing agent and that has been subjected to rolling and cooling-off processes, wherein the binder resin has a glass transition temperature of not less than 55° C., and wherein the binder resin has a dielectric loss tangent (tan δ) of not more than 50.

2. The electrophotographing toner as defined in claim 1, further comprising:

a coloring agent that is added during the melt-kneading process.

3. The electrophotographing toner as defined in claim 1, wherein, upon melt-kneading a mixture containing the binder resin and the mold-releasing agent, an outlet setting temperature is set at such a temperature that the binder resin has a melt viscosity of not less than 100 Pa·s.

4. The electrophotographing toner as defined in claim 3, further comprising:

a coloring agent that is added during the melt-kneading process.

5. The electrophotographing toner as defined in claim 1, wherein the melt index value of the binder resin is set in the range of 5.0 to 11.0.

6. The electrophotographing toner as defined in claim 5, further comprising:

a coloring agent that is added during the melt-kneading process.

7. The electrophotographing toner as defined in claim 1, wherein the content of the mold-releasing agent is set in the range of 0.5 to 5 parts by weight with respect to 100 parts by weight of the binder resin.

* * * * *